US010605011B2

(12) United States Patent
Cochran

(10) Patent No.: US 10,605,011 B2
(45) Date of Patent: Mar. 31, 2020

(54) METHOD AND APPARATUS FOR DEPLOYING WELLBORE PUMP ON COILED TUBING

(71) Applicant: ZiLift Holdings, Limited, Aberdeen (GB)

(72) Inventor: Jamie Cochran, Inverurie (GB)

(73) Assignee: ZiLift Holdings Limited, Aberdeen (GB)

( * ) Notice: Subject to any disclaimer, the term of this patent is extended or adjusted under 35 U.S.C. 154(b) by 0 days.

(21) Appl. No.: 16/032,806

(22) Filed: Jul. 11, 2018

(65) Prior Publication Data

US 2018/0320454 A1 Nov. 8, 2018

Related U.S. Application Data

(63) Continuation of application No. PCT/GB2017/050086, filed on Jan. 13, 2017.
(Continued)

(51) Int. Cl.
*E21B 17/02* (2006.01)
*E21B 33/04* (2006.01)
(Continued)

(52) U.S. Cl.
CPC ..... *E21B 17/023* (2013.01); *E21B 17/042* (2013.01); *E21B 17/206* (2013.01);
(Continued)

(58) Field of Classification Search
CPC ..... E21B 33/04; E21B 43/128; E21B 17/023; E21B 17/042; E21B 17/206; E21B 17/04;
(Continued)

(56) References Cited

U.S. PATENT DOCUMENTS 4,331,203 A * 5/1982 Kiefer ..... E21B 33/076 166/339
5,180,014 A * 1/1993 Cox ..... E21B 19/22 166/384
(Continued)

FOREIGN PATENT DOCUMENTS

EP 0899421 A2 3/1999
WO 2015147649 A1 10/2015

OTHER PUBLICATIONS

International Preliminary Report on Patentability and Written Opinion of the International Searching Authority International Application No. PCT/GB2017/050086, International filing date of Jan. 13, 2017.
(Continued)

*Primary Examiner* — Jennifer H Gay
(74) *Attorney, Agent, or Firm* — Richard A. Fagin

(57) ABSTRACT

A method for deploying a pump in a wellbore includes coupling the pump to an end of a coiled tubing having upper and lower coiled tubing portions interconnected by a releasable tubing connector, and inserting the pump into the wellbore by extending the coiled tubing therein until the releasable tubing connector is disposed in a suspending arrangement proximate a surface of the wellbore. The method includes uncoupling the upper coiled tubing portion from the releasable connector, wherein the releasable connector, lower coiled tubing portion and pump are retained suspended in the wellbore from the suspending arrangement.

16 Claims, 23 Drawing Sheets

Related U.S. Application Data

(60) Provisional application No. 62/278,150, filed on Jan. 13, 2016.

(51) Int. Cl.
*E21B 34/02* (2006.01)
*E21B 43/12* (2006.01)
*E21B 17/042* (2006.01)
*E21B 17/20* (2006.01)
*E21B 19/08* (2006.01)

(52) U.S. Cl.
CPC ..... *E21B 19/08* (2013.01); *E21B 33/0407* (2013.01); *E21B 34/02* (2013.01); *E21B 43/128* (2013.01)

(58) Field of Classification Search
CPC ..... E21B 17/06; E21B 19/08; E21B 19/22; E21B 19/16; E21B 17/20
See application file for complete search history.

(56) References Cited

U.S. PATENT DOCUMENTS 5,411,085 A * 5/1995 Moore ..... E21B 17/20 166/242.2
5,697,439 A * 12/1997 Kopfman ..... E21B 19/22 166/88.3
5,727,631 A * 3/1998 Baker ..... E21B 19/22 166/379
5,778,978 A * 7/1998 Crow ..... E21B 17/025 166/254.2
6,192,981 B1 * 2/2001 Boquet ..... E21B 19/10 166/75.13
6,192,983 B1 * 2/2001 Neuroth ..... E21B 17/028 166/250.15
6,213,202 B1 * 4/2001 Read, Jr. ..... E21B 17/06 166/55.1
6,220,358 B1 * 4/2001 Leniek, Sr. ..... E21B 19/22 166/369
6,328,111 B1 * 12/2001 Bearden ..... E21B 23/00 166/381
6,439,618 B1 * 8/2002 Beeman ..... E21B 17/04 166/242.2
6,450,541 B1 * 9/2002 Bakke ..... E21B 17/06 285/2
6,561,278 B2 * 5/2003 Restarick ..... E21B 17/028 166/378
6,571,879 B1 * 6/2003 Bebak ..... E21B 17/028 166/105
7,455,105 B1 * 11/2008 McKee ..... E21B 17/20 166/77.2
7,677,302 B2 * 3/2010 Ehtesham ..... E21B 17/046 166/242.6
7,748,444 B2 * 7/2010 Scott ..... E21B 33/0385 166/65.1
8,714,261 B2 * 5/2014 Sbordone ..... E21B 33/076 166/338
9,874,065 B2 * 1/2018 Christensen ..... E21B 17/01
2005/0189116 A1 * 9/2005 See ..... E21B 43/128 166/344
2005/0274511 A1 * 12/2005 Collins ..... E21B 23/02 166/254.2
2007/0000670 A1 * 1/2007 Moore ..... E21B 19/22 166/384
2007/0044960 A1 * 3/2007 Lovell ..... E21B 17/206 166/250.07
2007/0295502 A1 * 12/2007 Watson ..... E21B 43/128 166/254.2
2008/0041596 A1 * 2/2008 Blount ..... E21B 17/20 166/380
2008/0196902 A1 * 8/2008 Head ..... E21B 33/1275 166/381
2008/0210441 A1 * 9/2008 Scott ..... E21B 33/0385 166/385
2010/0116506 A1 * 5/2010 Sbordone ..... E21B 33/076 166/345
2011/0024133 A1 * 2/2011 Sach ..... E21B 17/023 166/377
2011/0163560 A1 * 7/2011 Manke ..... E21B 17/06 294/86.18
2012/0018142 A1 * 1/2012 Spence ..... E21B 17/023 166/77.1
2013/0098632 A1 * 4/2013 Wetzel ..... E21B 43/128 166/373
2013/0309016 A1 * 11/2013 McKee ..... F16L 1/202 405/170
2014/0000895 A1 * 1/2014 Misselbrook ..... E21B 29/04 166/298
2015/0027728 A1 * 1/2015 Tetzlaff ..... E21B 43/128 166/378
2015/0068769 A1 * 3/2015 Xiao ..... E21B 33/0407 166/382
2015/0322732 A1 * 11/2015 Naumann ..... E21B 17/20 166/380
2016/0186507 A1 * 6/2016 Varkey ..... E21B 43/128 166/250.01
2016/0245024 A1 * 8/2016 Nicholson ..... E21B 17/06
2016/0258231 A1 * 9/2016 Naumann ..... E21B 17/003
2016/0319607 A1 * 11/2016 Maclean ..... E21B 17/003
2016/0322739 A1 * 11/2016 Taylor ..... E21B 17/20
2017/0130535 A1 * 5/2017 Helvenston ..... E21B 23/00
2017/0191339 A1 * 7/2017 Christensen ..... E21B 17/01
2017/0211339 A1 * 7/2017 Emerson ..... E21B 17/003
2018/0320454 A1 * 11/2018 Cochran ..... E21B 33/0407

OTHER PUBLICATIONS

International Search Report and Written Opinion, International Application No. PCT/GB2017/050086, dated May 16, 2017.

* cited by examiner

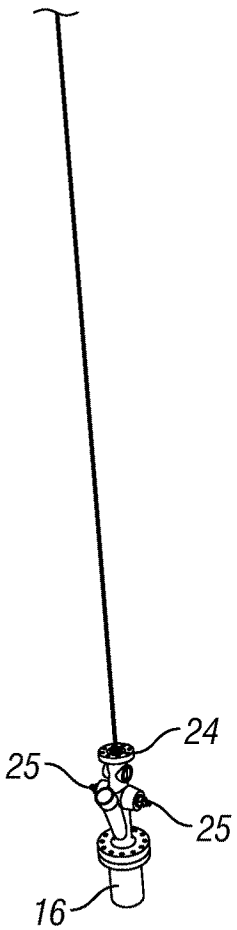
FIG. 2
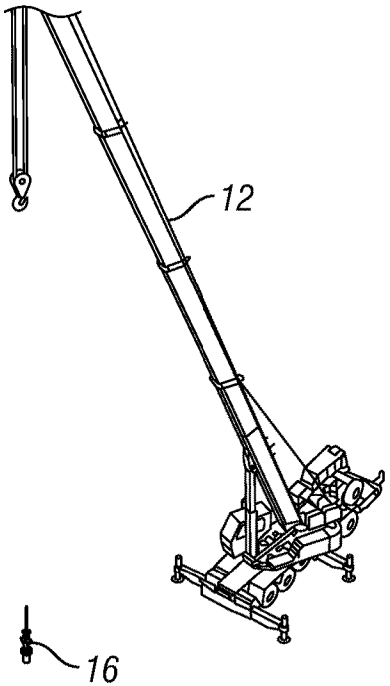
FIG. 1
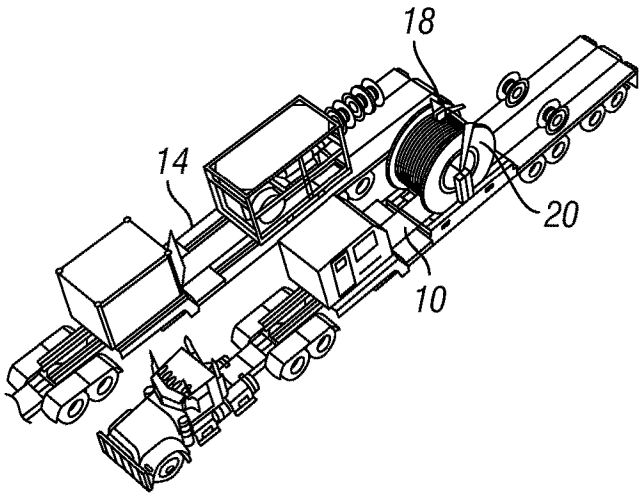

METHOD AND APPARATUS FOR DEPLOYING WELLBORE PUMP ON COILED TUBING

CROSS-REFERENCE TO RELATED APPLICATIONS

Continuation of International Application No. PCT/GB2017/050086 filed on Jan. 14, 2017. Priority is claimed from U.S. Provisional Application No. 62/278,150 filed on Jan. 14, 2016. The foregoing applications are incorporated herein by reference in their entireties.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable

BACKGROUND

This disclosure relates to the field of wellbore pumps, such as electric submersible pumps (ESPs). More particularly, the present disclosure relates to methods and apparatus for deploying ESPs on coiled tubing having an electrical cable associated therewith, wherein the coiled tubing is used as a conduit to move fluid out of a wellbore.

Background

Wellbore fluid pumps, such as ESPs may be deployed into wellbores at the end of a conveyance such as coiled tubing. Coiled tubing pump deployment known in the art typically only uses the coiled tubing to support the weight of the ESP as it is lowered to a selected depth in the wellbore through the production tubing.

Such deployment methods may require first, that the ESP includes some form of anchor or locking and sealing mechanism to hold the ESP within the production tubing string and to isolate the intake from the discharge of the pump. Finally, specialized seal elements may be required in order to enable the electrical cable to pass through a wellhead (one or more valves disposed at the surface end of the tubing string and surface well casing) while enabling the wellhead to be closed to stop fluid flow from the wellbore if and as needed.

SUMMARY

One aspect of the present disclosure relates to a method for deploying a pump in a wellbore, comprising:

- coupling the pump to an end of a coiled tubing having upper and lower coiled tubing portions interconnected by a releasable tubing connector;
- inserting the pump into the wellbore by extending the coiled tubing therein until the releasable tubing connector is disposed in a suspending arrangement proximate a surface of the wellbore; and
- uncoupling the upper coiled tubing portion from the releasable connector, wherein the releasable connector, lower coiled tubing portion and pump are retained suspended in the wellbore from the suspending arrangement.

When installed, the lower coiled tubing portion retained within the wellbore may provide a fluid conduit or passage to facilitate communication of pumped fluids to surface.

The releasable tubing connector may function to provide engagement with the suspending arrangement, for example mechanical engagement, such that the lower coiled tubing portion and pump are suspended in the wellbore via the releasable tubing connector. The method may comprise mechanically engaging the releasable tubing connector with the suspending arrangement.

The releasable tubing connector may function to provide sealing engagement with the suspending arrangement. The method may comprise sealingly engaging the releasable tubing connector with the suspending arrangement.

The suspending arrangement may comprise one or more rams provided in a wellhead assembly. For example, the suspending arrangement may comprise one or more rams of a blowout preventer (BOP), such as a rod lock BOP, coiled tubing BOP or the like.

The suspending arrangement may comprise a tubing hanger profile provided within a wellhead assembly. The method may comprise providing a tubing hanger profile on the releasable tubing connector to facilitate engagement with the tubing hanger profile provided within the wellhead assembly. The tubing hanger profile may provide one or both of mechanical and sealing engagement.

A wellhead assembly incorporating a tubing hanger profile may comprise a wellhead tree, for example.

The method may comprise deploying the coiled tubing from a reel. The releasable tubing connector may provide a connection between the upper and lower coiled tubing portions with minimal disruption to the ability to coil or spool the coiled tubing on the reel. The releasable tubing connector may also be defined as a spoolable connector.

An electrical cable may extend through the coiled tubing. The method may comprise providing the coiled tubing with the electrical cable preinstalled therein. The electrical cable may extend through both the upper and lower coiled tubing sections, and also through the releasable tubing connector.

The method may comprise coupling the pump to the electrical cable, for example prior to inserting the pump into the wellbore. The electrical cable may provide power and/or control to the pump, for example from a surface location. The electrical cable may be releasable from the pump when the pump is deployed, for example to permit the cable to be removed from the wellbore independently from the pump and the coiled tubing.

The electrical cable may comprise a tubing encapsulated electrical cable.

The method may comprise securing the electrical cable within the releasable tubing connector. The electrical cable may be secured within the releasable tubing connector prior to deployment into the wellbore. The method may comprise suspending the electrical cable within the releasable tubing connector. In this way the lower coiled tubing portion (and the connected pump) and the electrical cable may be suspended from the releasable tubing connector, wherein the releasable tubing connector is suspended from the suspending arrangement.

The method may comprise suspending the electrical cable from a cable hanger portion located within the releasable tubing connector. The cable hanger portion may form part of the releasable tubing connector. In one example the cable hanger portion may be secured to the electrical cable. The cable hanger portion may be mechanically secured to the cable hanger portion, for example via a clamping arrangement, friction arrangement or the like. The cable hanger portion may be sealingly secured to the electrical cable.

The cable hanger portion may be mechanically engaged within the releasable tubing connector, for example via an inter-engaging profile, such as a no-go profile. The cable hanger portion may include a load support feature to transfer axial load from the cable to the releasable tubing connector.

The cable hanger portion may be sealingly engaged within the releasable tubing connector. The cable hanger portion may be moveable within the releasable tubing connector. Such movement may selectively provide and remove a seal between the cable hanger portion and the releasable tubing connector, as described in more detail below. In one example the cable hanger portion may function as a seal shuttle.

The releasable tubing connector may comprise one or more flow ports providing fluid communication between an interior of the coiled tubing and an exterior thereof. The method may comprise operating a sealing shuttle inside the releasable tubing connector to selectively open and close the flow ports. In one example the sealing shuttle may be provided by a cable hanger portion within the releasable tubing connector.

The method may comprise providing a wellhead telescoping arrangement, and operating the sealing shuttle by extending and retracting a telescoping section of the telescoping arrangement.

The method may comprise locking the sealing shuttle in the releasable tubing connector. The locking may be performed by a latch arrangement, such as by a collet, split ring or the like.

The method may comprise cutting the upper coiled tubing portion and the electrical cable therein at a selected distance above the releasable tubing and retaining an upper coiled tubing stub portion coupled to the releasable tubing connector. The step of uncoupling the upper coiled tubing portion from the releasable connector may comprise uncoupling the upper coiled tubing stub portion from the releasable tubing connector, and exposing a selected length of the electrical cable.

The method may comprise coupling the cable to a source of electric current to operate the pump.

A wellhead or wellhead equipment provided at the surface of the wellbore may comprise a first fluid outlet in fluid communication with the flow ports in the releasable tubing connector and a second fluid outlet hydraulically separated from the flow ports and in fluid communication with an annular space between the coiled tubing and a surface casing extending from the wellhead and into the wellbore.

The method may comprise affixing a coiled tubing pressure control apparatus at the surface end of the well, for example on top of the wellhead. The method may comprise closing the coiled tubing pressure control apparatus to flow. The method may comprise lifting the pump into a lubricator and affixing the lubricator to the top of the coiled tubing pressure control apparatus. The method may comprise opening the coiled tubing pressure control apparatus (and optionally the suspending arrangement, if required to allow passage of the pump and coiled tubing) prior to extending the coiled tubing.

The wellhead adapter may comprise a segment of conduit sealingly engageable with an interior of an opening in the top of the wellhead and a cable adapter sealingly engageable with an interior of the segment of conduit and with an exterior of the cable.

One aspect of the present disclosure relates to a method for retrieving a pump from a wellbore, comprising:

connecting an interface component to a releasable tubing connector located in a suspending arrangement proximate a surface of the wellbore, wherein a lower coiled tubing portion with the pump coupled to a lower end thereof is suspended from the releasable tubing connector; and withdrawing the releasable tubing connector, lower coiled tubing portion and pump from the wellbore on the interface component.

The method may comprise completely withdrawing the releasable tubing connector, lower coiled tubing portion and pump from the wellbore on the interface component, for example by coiling onto a reel.

The method may comprise providing initial withdrawal of the releasable tubing connector, lower coiled tubing portion and pump on the interface component, and subsequently disconnecting the interface component from the releasable tubing connector. The method may comprise subsequently connecting an upper portion of coiled tubing to the releasable tubing connecting and then completing withdrawal of the releasable tubing connector, lower coiled tubing portion and pump from the wellbore.

One aspect of the present disclosure relates to a releasable tubing connector for providing a releasable connection between first and second tubing portions, comprising:

an intermediate portion;

a first tubing connector releasably coupled to one end of the intermediate portion, wherein the first tubing connector is connectable to a first tubing portion;

a second tubing connector coupled to an opposite end of the intermediate portion; and a cable hanger portion mounted within and mechanically engageable with the intermediate portion, wherein the cable hanger portion is connectable to an electrical cable which extends at least partially through the releasable tubing connector.

The releasable connector may be provided or used in the method according to any other aspect.

The releasable connector may be utilised to permit an electrical cable to be suspended from the releasable connector, such as an electrical cable, while also facilitating a releasable connection between first and second tubing portions. Such an arrangement may advantageously provide benefits in relation to the deployment of a pump within a wellbore, for example in accordance with any other aspect.

The releasable tubing connector may be a releasable coiled tubing connector for providing a releasable connection between first and second coiled tubing portions. The releasable tubing connector may be a spoolable releasable tubing connector.

The releasable tubing connector may be deployable into a wellbore. In one example, when deployed within a wellbore the first tubing connector may be defined as an upper tubing connector which is connectable to an upper tubing portion. Similarly, the second tubing connector may be defined as a lower tubing connector which is connectable to a lower tubing portion.

The releasable tubing connector may be disposable in a suspending arrangement within a wellbore. In such an arrangement the releasable tubing connector may be functional in suspending one of the first and second tubing portions (for example the second tubing portion) within the wellbore. The releasable tubing connector may be disposable within a suspending arrangement proximate a surface of the wellbore. The suspending arrangement may be provided within a wellhead assembly. The suspending arrangement may comprise one or more rams, for example which form part of a BOP. The suspending arrangement may be provided within a wellhead tree. The suspending arrangement may comprise a tubing hanger.

The first tubing connector may be releasable from the intermediate portion when the releasable tubing connector is deployed (for example in place within a wellbore or wellhead assembly.

The releasable tubing connector may comprise a tubing hanger profile provided on an outer surface thereof for engaging a tubing hanger. The tubing hanger profile may be releasably mountable on the releasable tubing connector. The tubing hanger profile may be provided on multiple segments assembled on the releasable tubing connector.

The first tubing connector may be coupled to the intermediate portion via any suitable releasable connection, such as via a threaded connection.

The second tubing connector may be releasably coupled to the intermediate portion, for example via a threaded connection. In an alternative example the second tubing connector may be permanently coupled to the intermediate portion. In one example the second tubing connector may be integrally formed with or as part of the intermediate portion.

The intermediate portion may be tubular.

The intermediate portion may comprise at least one port in a wall thereof for providing fluid communication between internal and external locations of the releasable connector. In one example the at least one port may facilitate outflow of a fluid driven by a pump connected to an opposing end of the second tubing portion.

The cable hanger portion may be moveable, for example axially moveable within the intermediate portion. The cable hanger portion may be moveable within the intermediate portion while connected to an electrical cable extending therein. Such movement may be permitted by virtue of compliance within the cable.

The cable hanger portion may be moveable within the intermediate portion to selectively open and close the at least one port. Selectively closing may comprise completely closing, for example to prevent flow. Selectively closing may comprise partially closing, for example to choke flow.

The cable hanger portion may function as a sealing shuttle.

The cable hanger portion may be moveable under control of an external actuator. In one example the cable hanger portion may be moveable under control of a wellhead penetrator, such as a telescoping wellhead penetrator.

In some examples the releasable tubing connector may comprise an actuator for providing movement of the cable hanger portion.

The cable hanger portion may comprise a seal extension which is configured to be inserted and removed from a sealing bore within the releasable tubing connector during movement of the cable hanger portion. The sealing bore may be provided within the intermediate portion. The sealing bore may be provided within the second tubing connector. The sealing bore may be located below the at least one port.

The cable hanger portion may be initially secured to the intermediate portion, for example via one or more shear elements, such as shear screws. The cable hanger portion may be releasable from the intermediate portion, for example upon application of a predetermined force.

The cable hanger portion may be configured to be connected, for example latched, relative to the intermediate portion to prevent or limit further relative movement between the cable hanger portion and the intermediate portion.

An aspect of the present disclosure relates to a wellbore pump assembly, comprising:

- a first coiled tubing portion;
- a pump coupled to one end of the first coiled tubing portion;
- a releasable tubing connector coupled to an opposite end of the first coiled tubing portion; and
- a second coiled tubing portion releasably coupled to the releasable connector.

The wellbore pump system may further comprise an electrical cable extending from the pump and through the first and second coiled tubing portions and the releasable connector. The releasable connector may comprise a cable hanger portion to interconnect the electrical cable relative to the releasable connector.

One aspect of the present disclosure relates to a method for deploying a pump in a wellbore, comprising:

- coupling the pump to an end of a coiled tubing, the coiled tubing having a releasable connector disposed therein at a longitudinal position corresponding to the total setting depth of the pump in the wellbore;
- inserting the pump into the wellbore by extending the coiled tubing therein until the connector is disposed in a means for suspending the connector proximate a surface end of the wellbore;
- uncoupling the connector; and
- affixing a wellhead adapter to the surface end of the wellbore, the wellhead adapter having a fluid tight seal to engage an upper end of a wellhead coupled to an upper end of a surface casing in the wellbore, the wellhead adapter having a fluid tight seal for engaging a cable disposed inside the coiled tubing.

The connector may comprise flow ports in fluid communication between an interior of the coiled tubing and an exterior thereof.

The method may further comprise operating a sealing shuttle inside the wellhead adapter to selectively open and close the flow ports. The sealing shuttle may be operable by extending and retracting a telescoping section of the wellhead adapter operable to raise and lower a cable hanger having a sealing body and seal affixed thereto.

The method may further comprise locking the sealing shuttle in the connector.

The locking may be performed by collets latched into a latching feature in the connector.

The method may further comprise cutting the coiled tubing and the cable therein at a selected distance above the connector prior to uncoupling the connector to expose a selected length of the cable.

The method may further comprise coupling the cable to a source of electric current to operate the pump.

The wellhead may comprise a first fluid outlet in fluid communication with the flow ports in the connector and a second fluid outlet hydraulically separated from the flow ports and in fluid communication with an annular space between the coiled tubing and the surface casing.

The cable may comprise a tubing encapsulated electrical cable.

The method may further comprise affixing a coiled tubing pressure control apparatus on top of the wellhead, closing the coiled tubing pressure control apparatus to flow, lifting the pump into a lubricator, affixing the lubricator to the top of the coiled tubing pressure control apparatus, and opening the coiled tubing pressure control apparatus and the means for suspending prior to extending the coiled tubing.

The wellhead adapter may comprise a segment of conduit sealingly engageable with an interior of an opening in the top of the wellhead and a cable adapter sealingly engageable with an interior of the segment of conduit and with an exterior of the cable.

The cable adapter may comprise a load support feature to transfer axial load from the cable to the segment of conduit.

The means for suspending may comprise a rod lock blowout preventer.

The connector may comprise a roll on or dimple fitting disposed inside the coiled tubing and wherein the rod lock blowout preventer is closed on a portion of the coiled tubing having the roll on fitting therein.

Aspects of the present disclosure relate to methods and apparatus for deploying and/or retrieving a pump. However, the principles of the present invention may also relate to the deployment and/or retrieval of any wellbore equipment.

One aspect of the present disclosure relates to a method for deploying a wellbore apparatus in a wellbore, comprising:

coupling the wellbore apparatus to an end of a coiled tubing having upper and lower coiled tubing portions interconnected by a releasable tubing connector;

inserting the wellbore apparatus into the wellbore by extending the coiled tubing therein until the releasable tubing connector is disposed in a suspending arrangement proximate a surface of the wellbore; and uncoupling the upper coiled tubing portion from the releasable connector, wherein the releasable connector, lower coiled tubing portion and wellbore apparatus are retained suspended in the wellbore from the suspending arrangement.

One aspect of the present disclosure relates to a method for retrieving a wellbore apparatus from a wellbore, comprising:

connecting an interface component to a releasable tubing connector located in a suspending arrangement proximate a surface of the wellbore, wherein a lower coiled tubing portion with the wellbore apparatus coupled to a lower end thereof is suspended from the releasable tubing connector; and withdrawing the releasable tubing connector, lower coiled tubing portion and wellbore apparatus from the wellbore on the interface component.

One aspect of the present disclosure relates to a valve to be interconnected between first and second tubing portions, comprising:

a housing defining at least one flow port;

a first tubing connector coupled to one end of the housing, wherein the first tubing connector is connectable to a first tubing portion;

a second tubing connector coupled to an opposite end of the housing; and a cable hanger portion mounted within the housing and being connectable to an electrical cable to permit the electrical cable to be suspended from the valve, wherein the cable hanger portion is moveable relative to the housing to selectively open and close the at least one flow port.

The valve may function to provide a connection between the first and second tubing portions. The valve may thus function as a tubing connector.

The first tubing connector may be releasably coupled to the housing. Alternatively, the first tubing connector may be permanently coupled to the housing, for example integrally formed with the housing. The second tubing connector may be releasably coupled to the housing. Alternatively, the second tubing connector may be permanently coupled to the housing, for example integrally formed with the housing.

The at least one flow port may be provided within a wall of the housing.

The cable hanger portion may function as a valve member. The cable hanger portion may function as a seal shuttle.

The valve may be provided in accordance with a releasable tubing connector according to any other aspect.

BRIEF DESCRIPTION OF THE DRAWINGS

FIG. 1 shows a coiled tubing unit, a crane and a transport truck positioned proximate a wellhead.

FIG. 2 shows a side entry, rod lock blowout preventer (BOP) being installed on the wellhead.

DETAILED DESCRIPTION OF THE DRAWINGS

Figure 3:
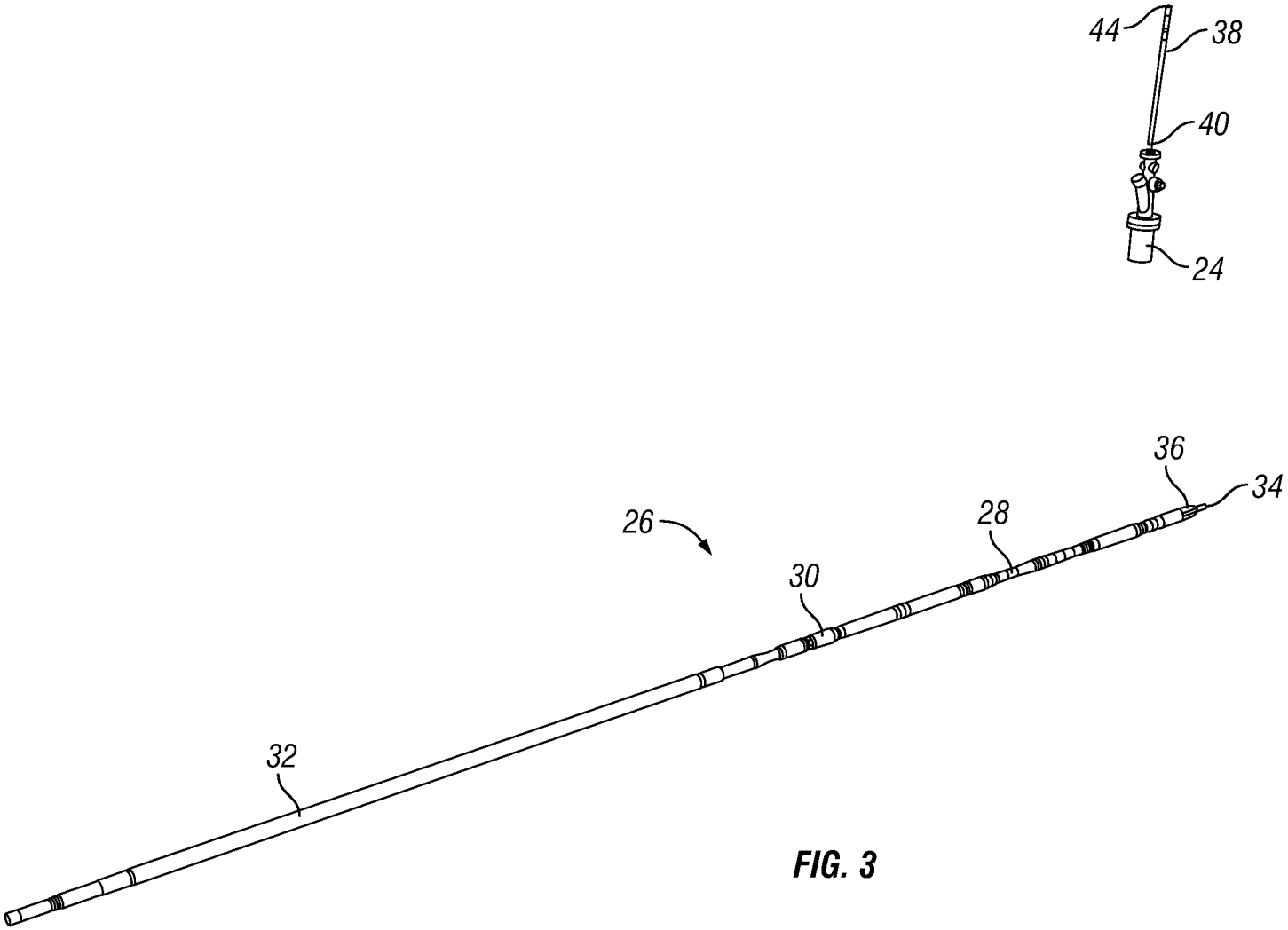
FIG. 3 shows an ESP system comprising an electric motor, gear unit and protector and a pump that is to be deployed in the wellbore.

FIG. 1 shows a coiled tubing unit 10, a crane 12 and a transport truck 14 positioned proximate a wellhead 16. The wellhead 16 is disposed at the surface and may comprise one or more valves to close a wellbore casing (not shown in FIG. 1) to fluid flow from the wellbore if and as needed. The coiled tubing unit 10 may be any conventional type of coiled tubing deployment apparatus known in the art for insertion of a coiled tubing 18, which may be stored on a reel 20 or similar device, into a wellbore. As will be described in detail below, in the present example the coiled tubing 18 is used to deploy and support an ESP (not shown in FIG. 1) in the wellbore, while providing a flow path for fluids to be delivered by the ESP to surface. The crane 12 may be used to lift and support various components of an ESP system, wellhead components and the coiled tubing deployment apparatus 10 as will be further explained below.

The coiled tubing 18 disposed on the reel 20 of the coiled tubing deployment apparatus 10 may include an electrical cable (not visible in FIG. 1) disposed therein which terminates close to an open (downhole) end of the coiled tubing 18. The cable is intended to provide power and/or control to a connected ESP.

The coiled tubing 18 may comprise a connector and cable hanger apparatus 22, which is not shown in FIG. 1 but explained in more detail below with reference to FIGS. 27 and 28. For the purposes of the present description the connector and cable hanger apparatus 22 may also be conveniently referred to as a connector 22. The connector 22 is disposed or located at a position along the coiled tubing 18 such that the connector 22 is disposed in a rod lock blowout preventer 24 (FIG. 2) when the coiled tubing 18 is extended into the wellbore with an ESP deployed at a selected depth in the wellbore. In this case the connector 22 may be supported in the rod block BOP 24 such that the coiled tubing 18 is suspended in the wellbore via the connector 22 and rod lock BOP 24. In some other examples the connector 22 may be held or engaged within other well head equipment, such as within a hanger profile of well head equipment such as a production tree. Thus, use of a rod lock BOP is optional.

The connector and cable hanger apparatus 22 may be used to interconnect separate portions of the coiled tubing 18, in this case upper and lower portions of the coiled tubing 18, while allowing the different portions to be separated during deployment operations (and reconnected during retrieval operations if necessary). In the present example the connector and cable hanger apparatus 22 provides a connection between the different portions (upper and lower portions) of the coiled tubing 18 while still permitting the coiled tubing 18 to be spooled on the reel 20. As such, the connector 22 may also be defined as a spoolable coiled tubing connector. The connector 22 may function to provide a mechanical connection between the coiled tubing portions. The connector 22 may also function to accommodate or mechanically support the electrical cable which is disposed within the coiled tubing 18. Further, the connector 22 may facilitate opening/closing of flow from the coiled tubing 18.

FIG. 2 shows a side entry, rod lock blowout preventer (BOP) 24 being installed on the wellhead 16. The side entry, rod lock BOP 24 will be further explained with reference to FIG. 14. However the rod lock BOP 24 may include a set of rams 25 which may sealingly engage the connector and cable hanger apparatus 22 (see FIG. 14) when the coiled tubing 18 is deployed to the selected depth. Although FIG. 2 suggests that the rod lock BOP 24 may be installed contemporaneously with the deployment of an ESP in the wellbore, it will be appreciated by those skilled in the art that the rod lock BOP 24 may also be installed on the wellhead 16 at any time prior to commencement of ESP deployment operations according to the present disclosure. Further, and as noted above, in some examples the rod lock BOP 24 may be omitted, with other wellhead equipment, such as a production tree, optionally utilised.

FIG. 3 shows an ESP system 26 comprising an electric motor 28, gear unit and protector 30 and a pump 32 that is to be deployed in the wellbore. An upper end of the ESP system 26 may comprise any form of electrical connector 34 to make fluid-sealed electrical connection between the electrical cable inside the coiled tubing 18 and the ESP system 26. The electrical connector 34 may facilitate remote disconnection from the electrical cable, for example independently of any disconnection of the coiled tubing 18. For example, the electrical connector 34 may permit disconnection upon application of a predetermined axial load applied along the electrical cable, for example applied from surface. A releasable arrangement may become activated upon exposure to the predetermined load. In some examples the releasable arrangement may comprise a shear assembly or the like. Such ability to disconnect from the ESP may be useful in contingency situations. For example, the cable may be removed in its entirety from the coiled tubing 18, allowing an intervention tool, such as a cutting tool, to be deployed through the coiled tubing 18.

The upper end of the ESP system 26 may also comprise a mechanical connector 36, such as a "roll on" connector, threaded connector or any other type of connector to couple the ESP system 26 to the end of the coiled tubing 18 such that the full weight of the ESP system 26 may be safely supported from the end of the coiled tubing 18, and that the outlet of the pump 32 in the ESP system 26 may be discharged into the interior of the coiled tubing 18 without any significant leakage of fluid from the connector 36.

FIG. 3 also shows a "lubricator" 38 which comprises a length of conduit or multiple conduits connected together and having an internal diameter large enough to enable free passage of the coiled tubing 18 and ESP system 26 therein. The lubricator 38 may comprise a connector 40 at one end thereof for making connection to either the upper end of the rod lock BOP 24, or a deployment or coiled tubing blowout preventer BOP (such as coiled tubing BOP 42 of FIG. 4) installed on the top of the rod lock BOP 24. An upper end of the lubricator 38 may comprise a seal element 44, such as hydraulically actuated packing glands well known in the art for sealingly engaging a cable or conduit moved through the seal element 44. The seal element 44 may also comprise a small-clearance bushing into which grease may be pumped under pressure, wherein the grease disposed in the clearance space between the outer surface of the coiled tubing 18 and the inner surface of the bushing provides a fluid tight seal as the coiled tubing 18 is moved through the seal element. The foregoing two types of seal element are only provided as examples and are not intended to limit the scope of the present disclosure.

Figure 4:
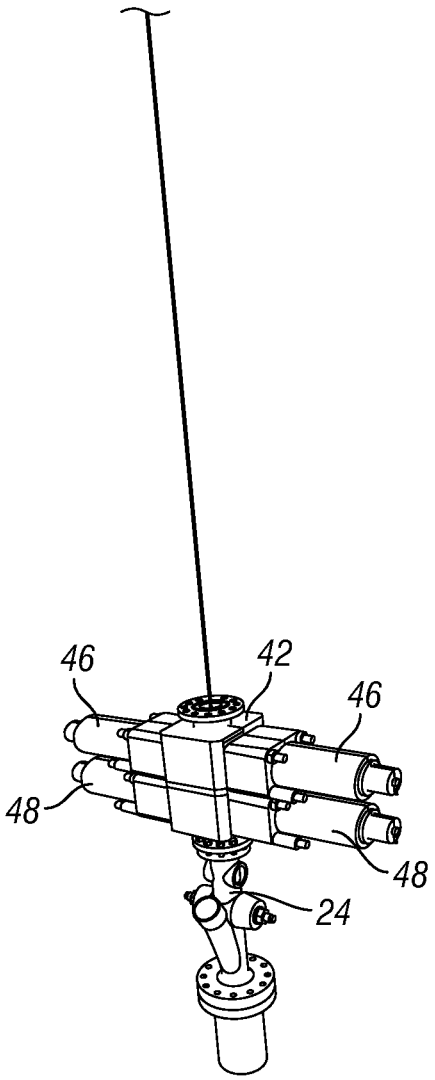
FIG. 4 shows a coiled tubing BOP being installed on the top of a rod-lock BOP.

FIG. 4 shows a coiled tubing BOP 42 being installed on the top of the rod-lock BOP 24. The coiled tubing BOP 42 may include, for example, two sets of opposed rams 46, 48. One set of rams 48 may be configured to sealingly engage the exterior surface of the coiled tubing 18 when closed (i.e., "pipe rams"). The other set of rams 46 in the example coiled tubing BOP 42 may be blind rams (which fully close and seal the wellbore when no object is disposed inside the rams) or shear rams (which seal as do blind rams when closed, but include the capability of shearing any object disposed in the rams at the time of closure). The illustrated coiled tubing BOP 42 is only meant to serve as an example and is not intended to limit the scope of the present disclosure.

Figure 5:
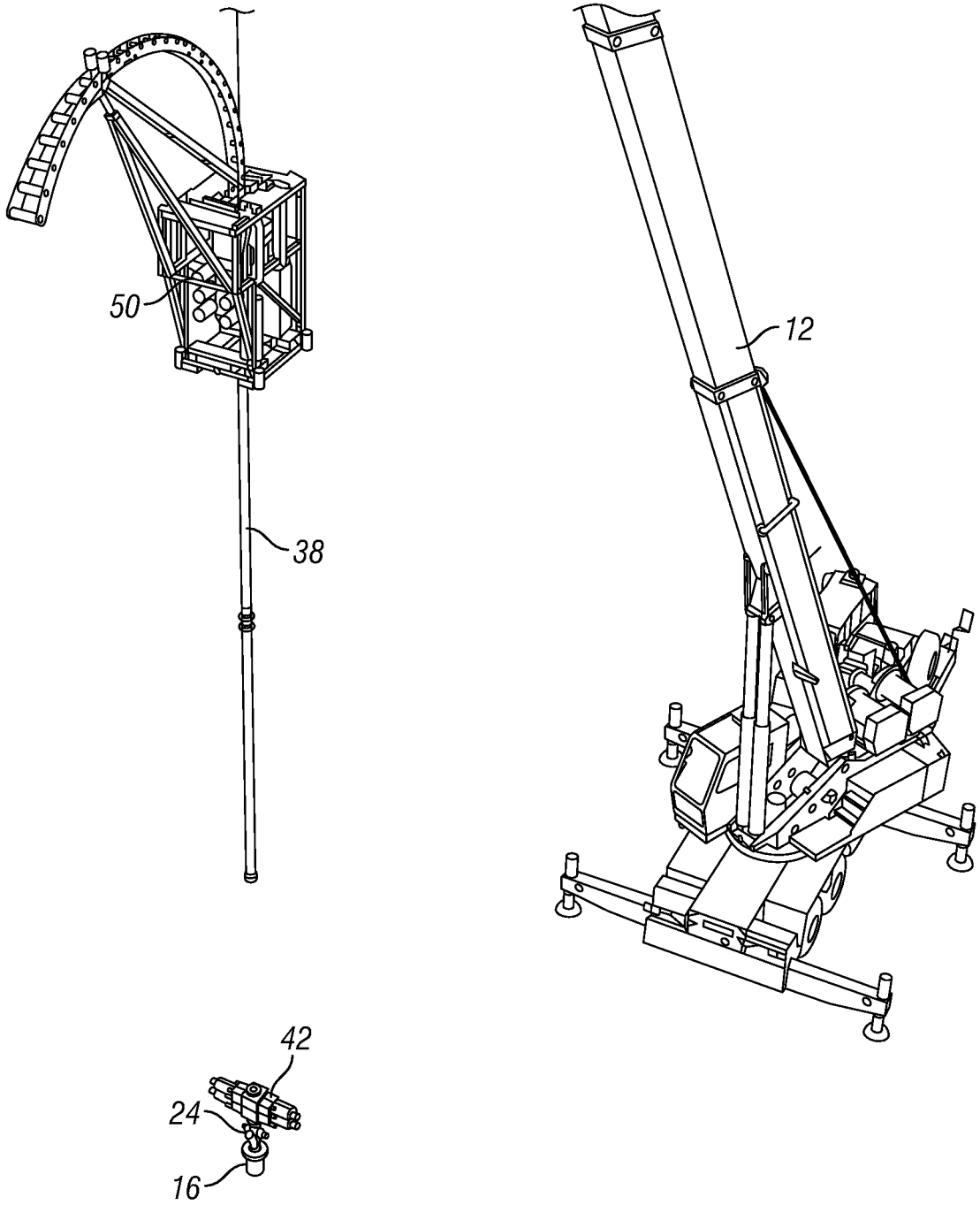
FIG. 5 shows a crane lifting and positioning over the wellhead the lubricator and an injector unit forming part of the coiled tubing deployment unit.
Figure 6:
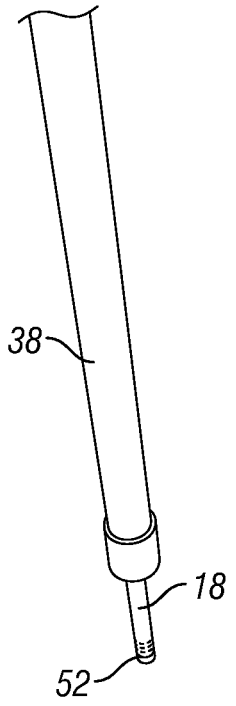
FIG. 6 shows an end connector is shown installed on the end of the coiled tubing.
Figure 6:
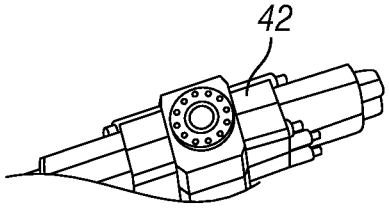

In FIG. 5, the crane 12 may lift and position over the wellhead 16 the lubricator 38 and an injector unit 50 forming part of the coiled tubing deployment unit 10. The coiled tubing 18 may be moved through the lubricator 38 by the injector unit 50 such that the lower end of the coiled tubing 18 is exposed, as illustrated in FIG. 6, to enable connecting the ESP system 26 thereto. In this respect an end connector 52 is provided on the end of the coiled tubing 18. Installation of the end connector 52 may be performed at the well site or may be performed at any time prior to moving the coiled tubing deployment apparatus 10 to the well site.

Figure 7:
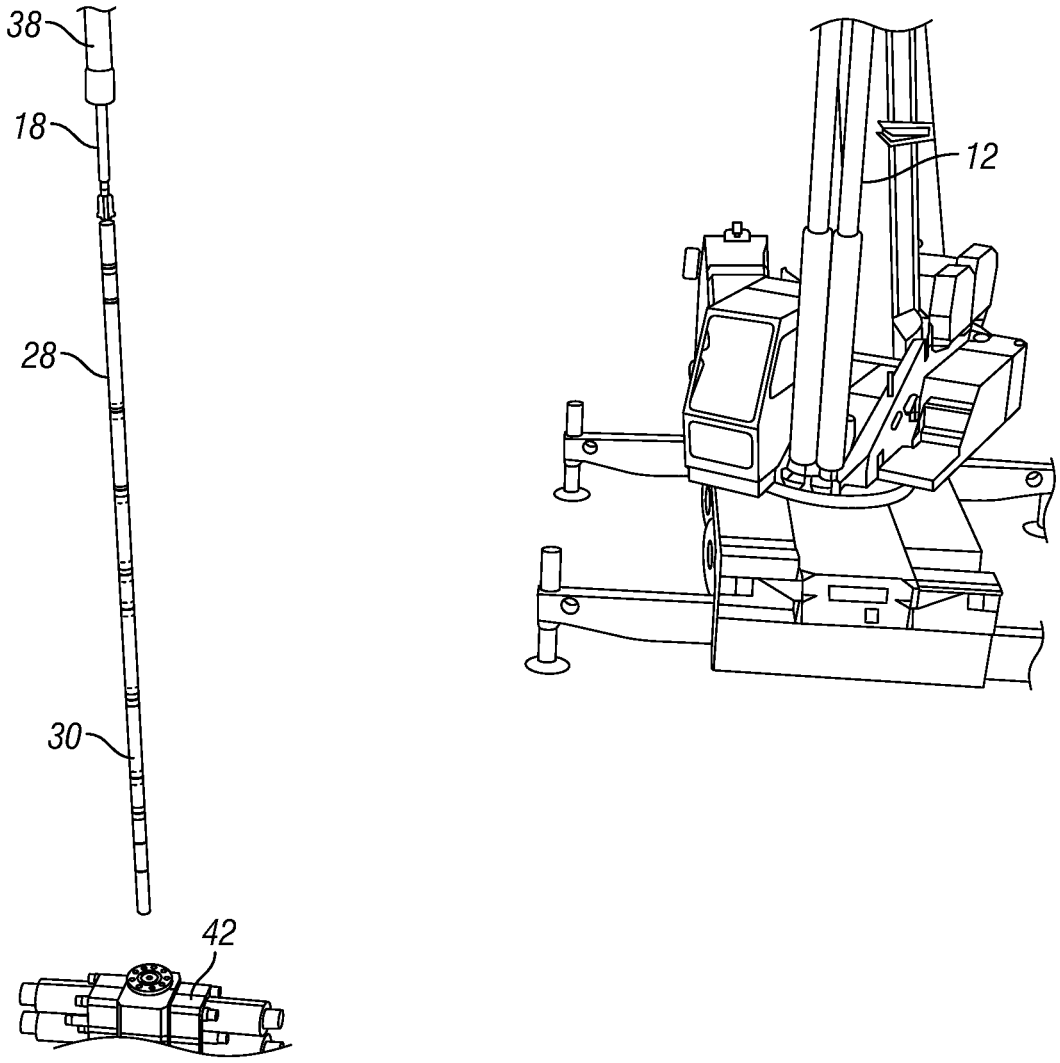
FIG. 7 shows the motor and drivetrain portion of the ESP system coupled to the end of the coiled tubing.
Figure 8:
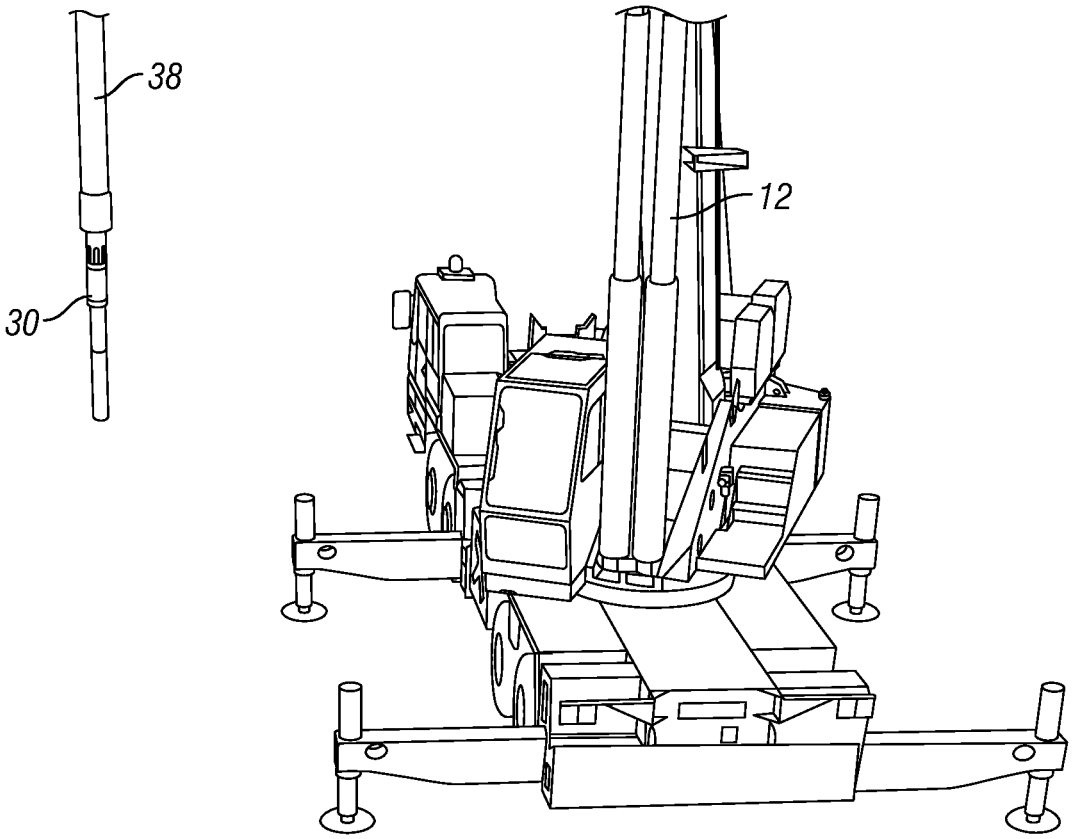
FIG. 8 shows the coiled tubing deployment apparatus operated to lift the motor and drivetrain portion of the ESP system fully into the lubricator.
Figure 8:
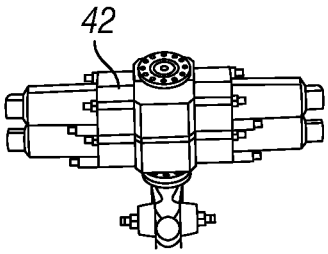
Figure 9:
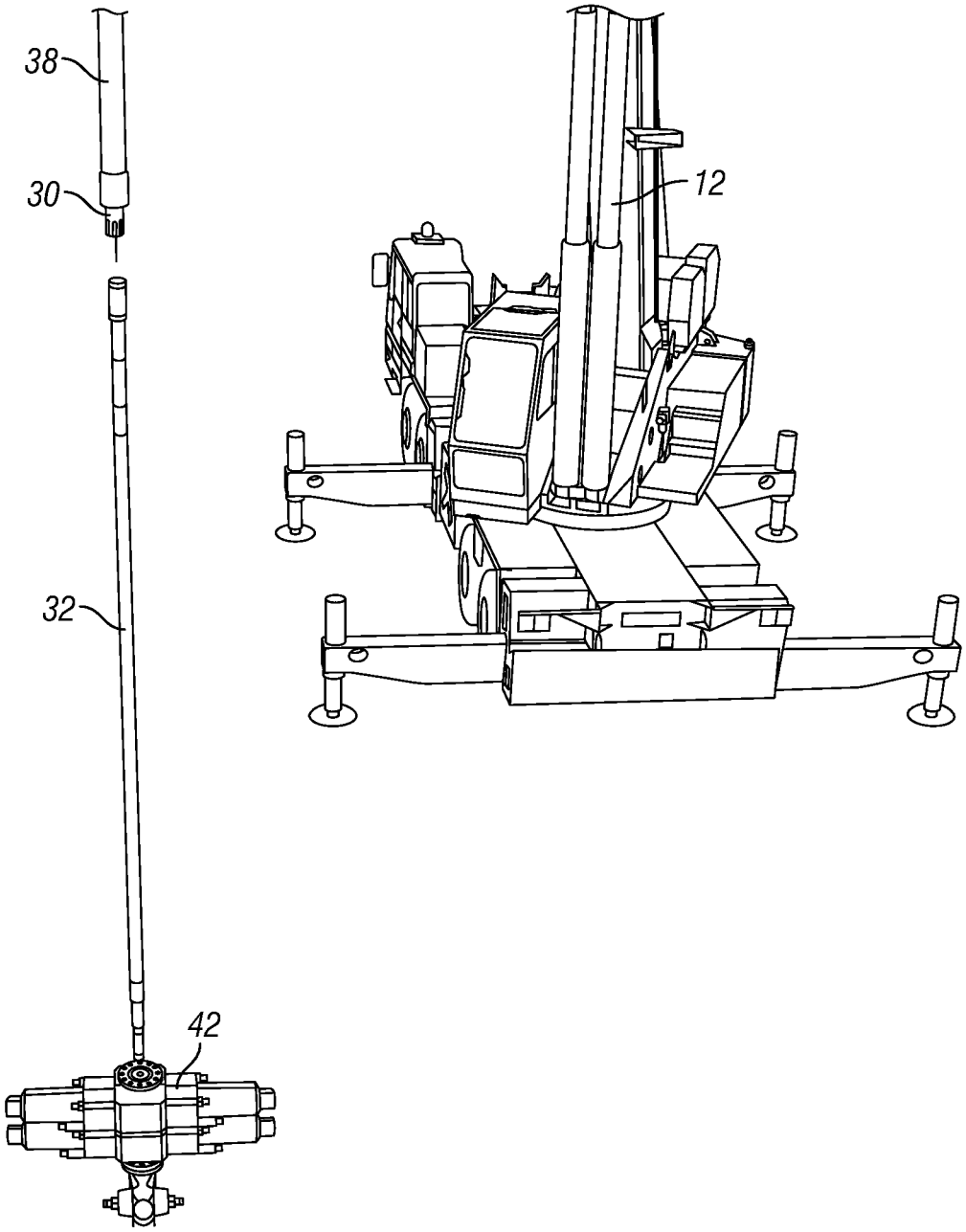
FIG. 9 shows the pump portion of the ESP system may be coupled to the lower end of the motor and drivetrain portion of the ESP system.
Figure 10:
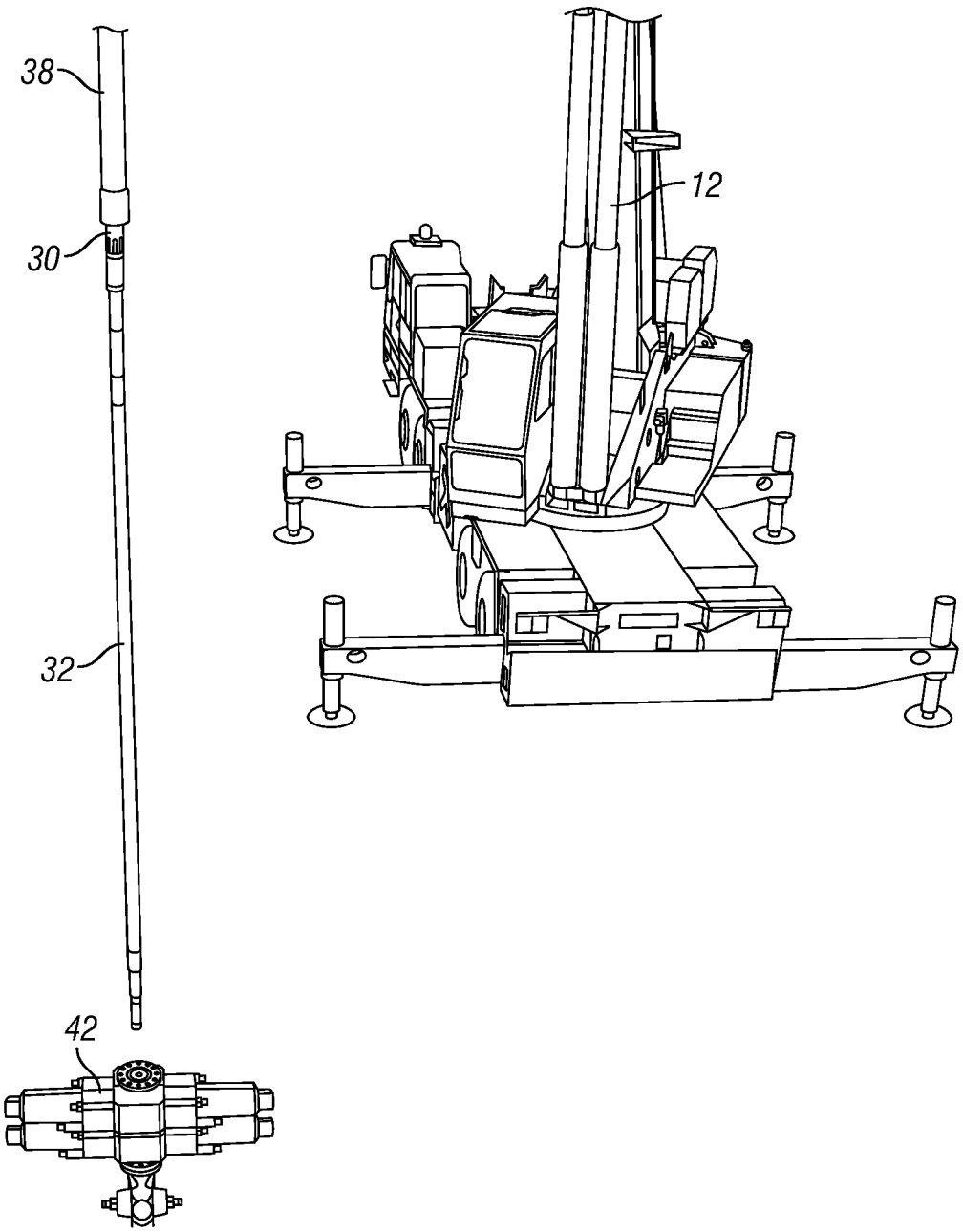
FIG. 10 shows making the connection of FIG. 9 using any form of connector, such as a quick-connect device.

In FIG. 7, the motor 28 and gear unit/protector 30 of the ESP system 26 is coupled to the end of the coiled tubing 18, e.g., using the connectors 34, 36, 52 as described above. In FIG. 8, the coiled tubing deployment apparatus 10 is operated to lift the motor 28 and gear unit/protector 30 of the ESP system 26 into the lubricator 38. In FIG. 9, the pump portion 32 of the ESP system 26 may be coupled to the lower end of the motor 28 and gear unit/protector 30 portion of the ESP system 26, for example, as shown in FIG. 10, using any form of connector, such as a quick-connect device.

Figure 11:
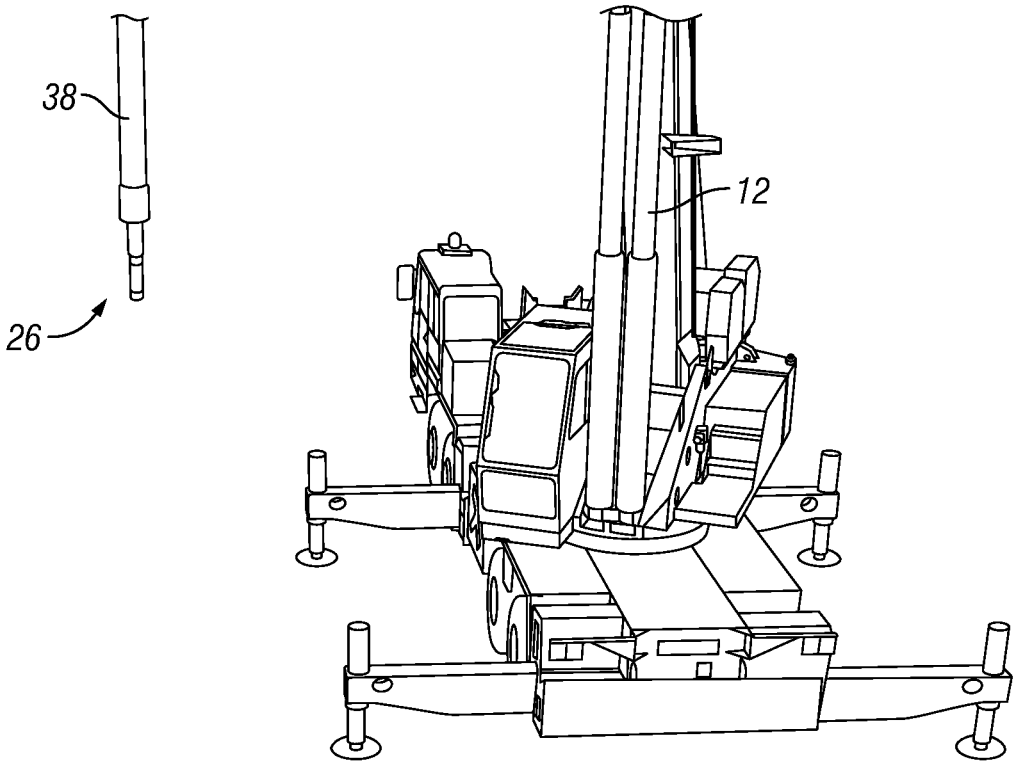
FIG. 11 shows the remaining portion of the ESP system lifted fully into the lubricator using the coiled tubing deployment apparatus.
Figure 11:
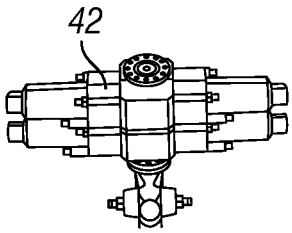

In FIG. 11, the remaining portion of the ESP system 36 protruding from the bottom of the lubricator 38 after assembly of the pump portion 32 thereof may be lifted fully into the lubricator 38 using the coiled tubing deployment apparatus 10.

Figure 12:
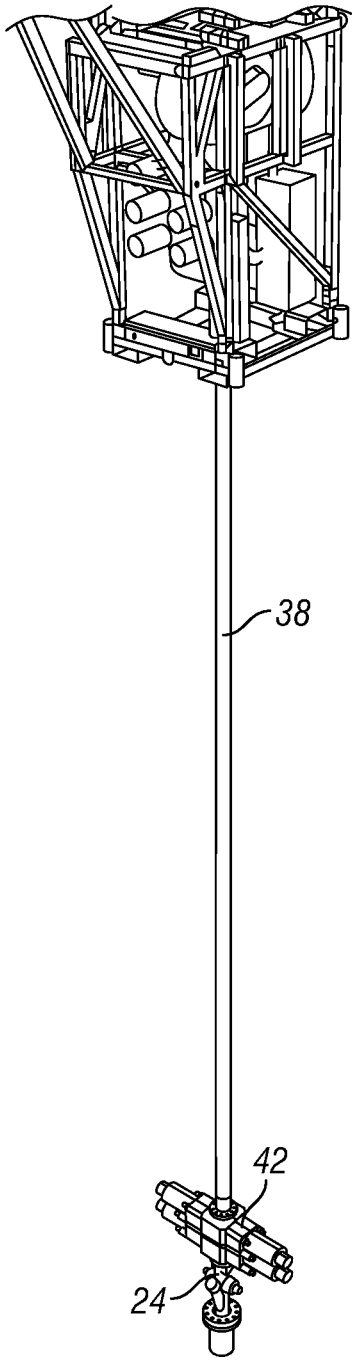
FIG. 12 shows the lubricator installed onto the coiled tubing BOP.

In FIG. 12, the lubricator 38 may be installed onto the coiled tubing BOP 42. It may be desirable to close the coiled tubing BOP 42, and provide fluid under pressure to the interior of the lubricator 38 to test the pressure sealing integrity of the lubricator 38 and its connection to the coiled tubing BOP 42 (or the rod lock BOP 24 if no coiled tubing BOP 42 is used).

Figure 13:
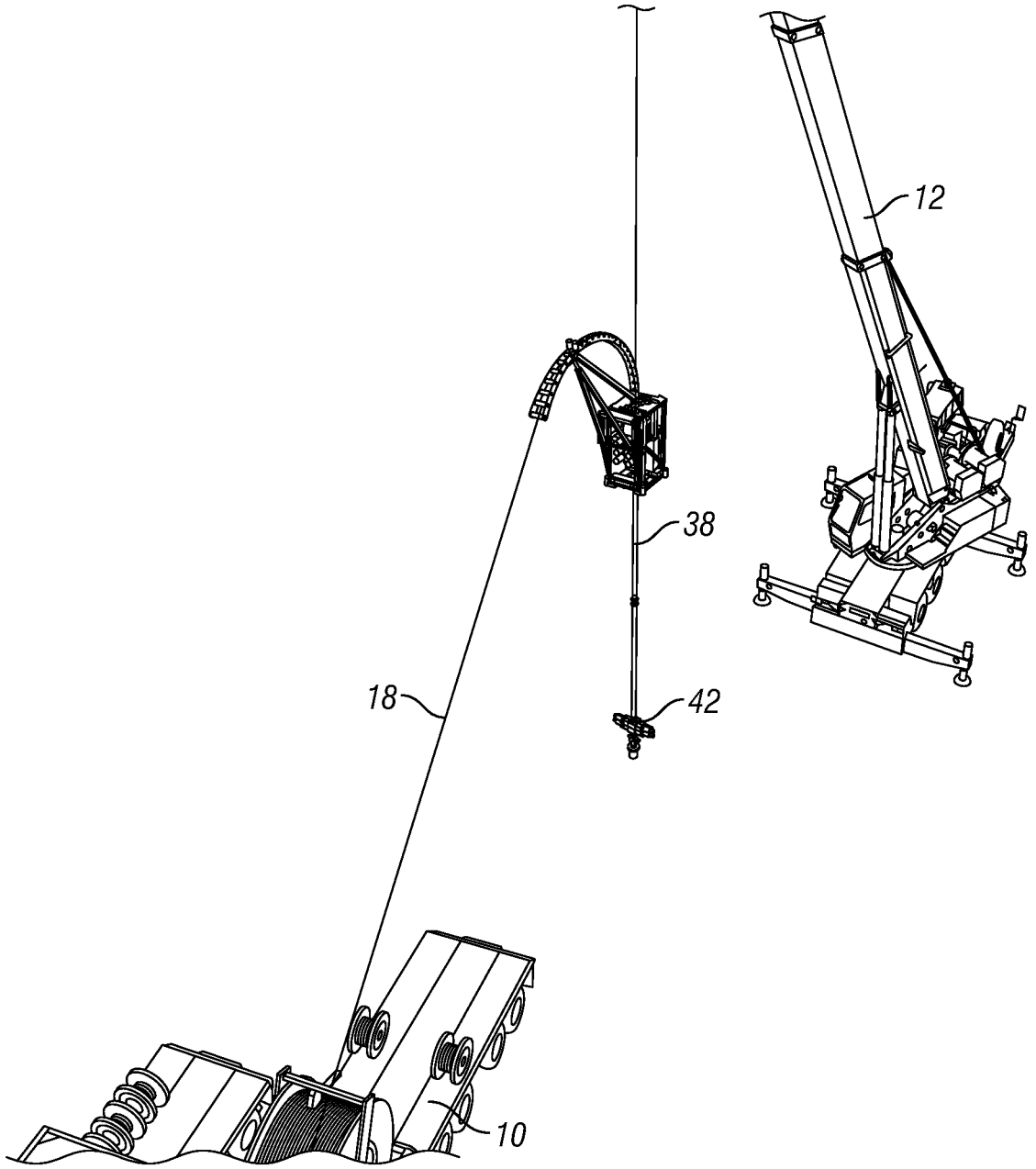
FIG. 13 shows the coiled tubing BOP being opened, and the coiled tubing deployment apparatus then operated to move the coiled tubing into the wellbore until the ESP system at the end of the coiled tubing is disposed at a selected depth.

In FIG. 13, the coiled tubing BOP 42 may be opened, and the coiled tubing deployment apparatus 10 then operated to move the coiled tubing 18 into the wellbore until the ESP system 26 at the end of the coiled tubing 18 is disposed at the selected depth. The selected depth may correspond to the position along the length of the coiled tubing 18 of the connector and cable hanger apparatus 22 described briefly above (and described in more detail below).

Figure 14:
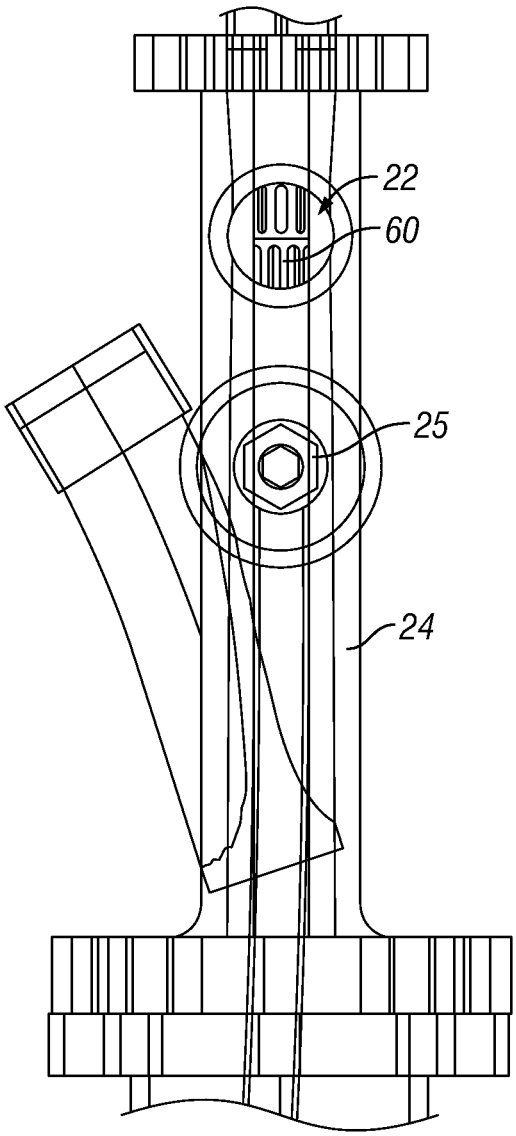
FIG. 14 shows a cut away view of the connector and cable hanger apparatus disposed inside the rod lock BOP.

FIG. 14 shows a cut away view of the connector and cable hanger apparatus 22 disposed inside the rod lock BOP 24. The connector and cable hanger apparatus 22 may include "no go" collar, collets or similar device to prevent the connector and cable hanger apparatus 22 from traveling further into the wellbore than the position of the rams 25 in the rod lock BOP 24. In the present example, the connector and cable hanger apparatus 22 may be positioned in the rod lock BOP 24 at a position where an internal coupling between the coiled tubing 18 and the connector and cable hanger apparatus 22, such as a roll on connector, is disposed in the rams 25 of the rod lock BOP 24. By positioning the connector and cable hanger apparatus 22 inside the rams 25, when the rams 25 are closed, the additional material thickness provided by the internal coupling may assist the rams 25 in sealingly engaging the exterior of the coiled tubing 18 (and supporting the weight of the ESP system 26 and coiled tubing 18 where a "no go" or similar hanging device is not used).

The connector and cable hanger apparatus 22 may comprise fluid discharge ports 60 above the position of the rams 25 in the rod lock BOP 24. The discharge ports 60 are aligned with one or more outlet ports 61 provided on the rod lock BOP 24. Suitable pipework (not shown) may be connected to the outlet ports 61 to receive flow from the wellbore and deliver this to appropriate production equipment. The rod lock BOP 24 may also include a separate fluid outlet 62 in fluid communication with the wellbore below the rams 25 in the rod lock BOP 24. Thus, the wellbore has two fluid outlets that are hydraulically isolated from each other; a first outlet 62 being in communication with the wellbore casing (below the rod lock BOP rams 25) and a second outlet 61 being in fluid communication through the fluid discharge ports 60 in the connector and cable hanger apparatus 22 with the interior of the coiled tubing 18.

Figure 16:
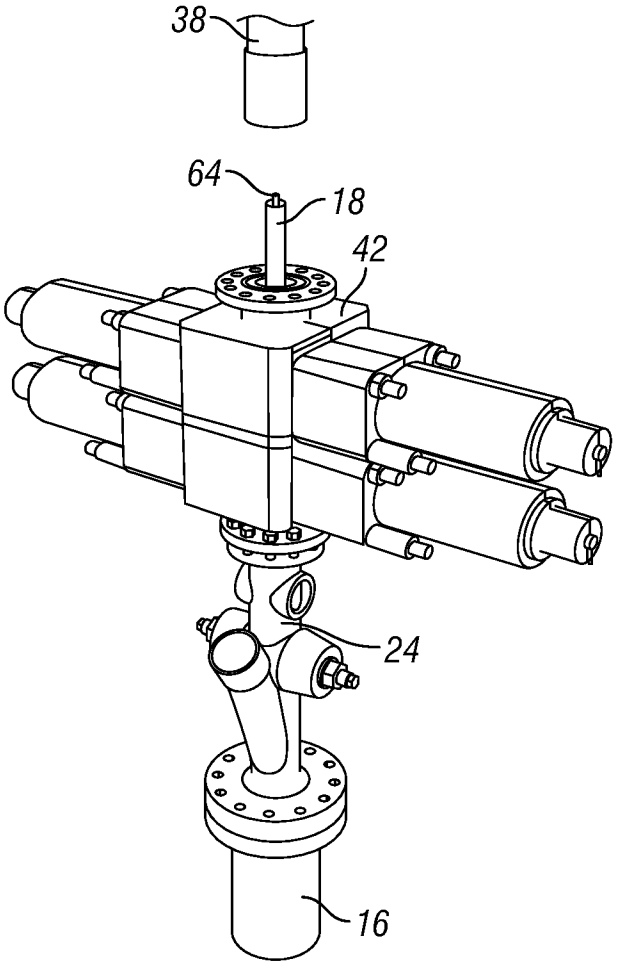
FIG. 16 shows the coiled tubing and electrical cable therein cut to enable the coiled tubing deployment apparatus and lubricator to be moved away from the wellbore.
Figure 15:
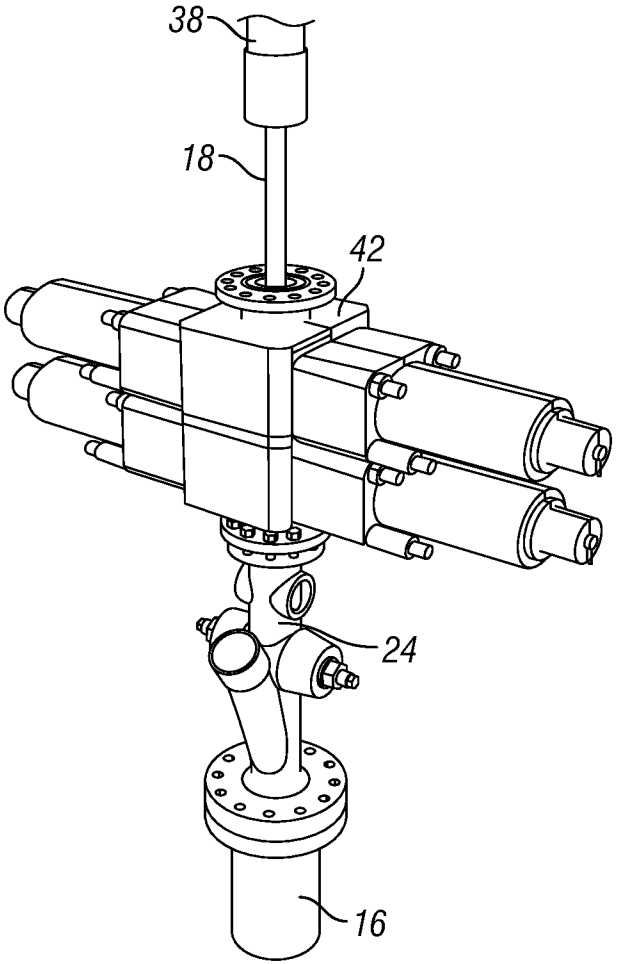
FIG. 15 shows the lubricator being disconnected from the coiled tubing BOP (if used, or the rod lock BOP if not used) and lifted to expose the coiled tubing above the connector and cable hanger apparatus.
Figure 17:
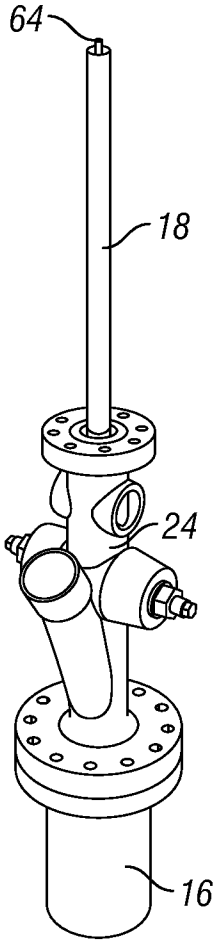
FIG. 17 shows the BOP removed and the exposed cut end of the coiled tubing.

In FIG. 15, the lubricator 38 may be disconnected from the coiled tubing BOP 42 (if used, or the rod lock BOP 24 if not used) and lifted to expose the coiled tubing 18 above the connector and cable hanger apparatus 22. In FIG. 16, the coiled tubing 18 and electrical cable 64 therein may be cut to enable the coiled tubing deployment apparatus and lubricator 38 to be moved away from the wellbore. The foregoing, with the exposed cut end of the coiled tubing 18, is shown in FIG. 17, with the coiled tubing BOP 42 removed/not illustrated.

Figure 18:
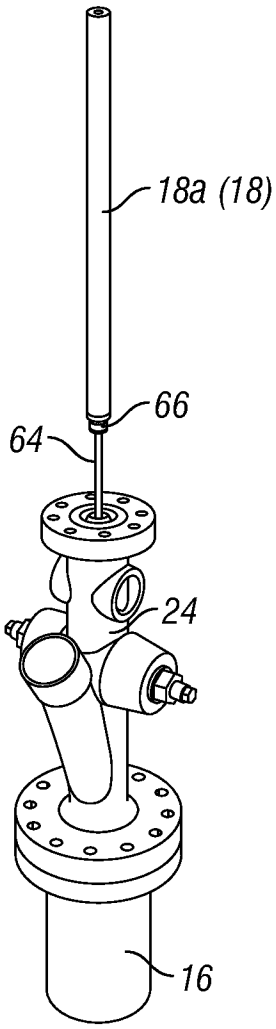
FIG. 18 shows an upper portion of the coiled tubing connector and cable hanger apparatus being disconnected/discarded.

In FIG. 18, an upper coiled tubing connector portion 66 of the connector and cable hanger apparatus 22 may be disconnected from the connector 22 (along with the remaining upper portion 18*a* of the coiled tubing 18), e.g., by unscrewing if a threaded connection is used, wherein the lower portion of the connector 22 is locked inside the rod lock BOP 24 as explained with reference to FIG. 14. By removing the upper coiled tubing connector portion 66, the electrical cable 64 will be exposed and will protrude through the open upper end of the rod lock BOP 24.

Figure 19:
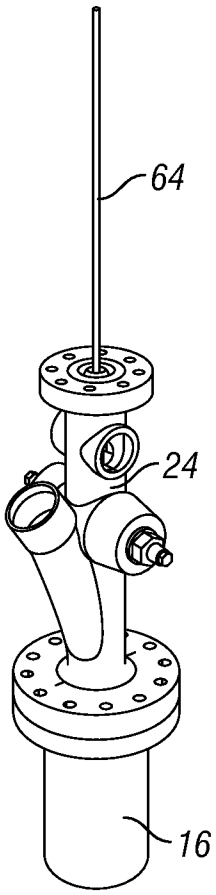
FIG. 19 shows a the cut electrical cable extending from the wellhead after the cut coiled tubing is removed by separating an upper portion of the connector and cable hanger apparatus

FIG. 19 shows the exposed end of the electrical cable 64 protruding from the rod lock BOP 24 after separation of the upper coiled tubing connector portion 66 and removal of the cut upper coiled tubing portion 18*a*.

Figure 20:
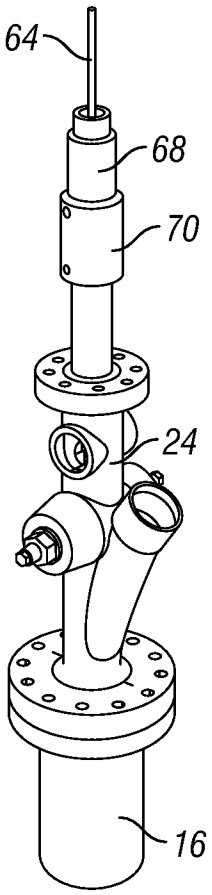
FIG. 20 shows an embodiment of a hydraulic telescoping wellhead penetrator assembly attached to the wellhead.

FIG. 20 shows a telescoping wellhead penetrator 68 disposed over the exposed end of the electrical cable 64 and inserted into the rod lock BOP 24. As will be further explained below, the telescoping wellhead penetrator 68 may be coupled to an internal shuttle component of the connector and cable hanger apparatus 22, such that the internal shuttle component may be raised and lowered to selectively open and close the flow ports 60 in the connector and cable hanger apparatus 22. Closure may hydraulically close the coiled tubing 18 to flow such that the entire well may be closed to flow. Telescoping may be obtained by using a hydraulic cylinder 70 as shown in FIG. 20, however other types of telescoping devices may be used, such as screw jacks or similar devices.

Figure 21:
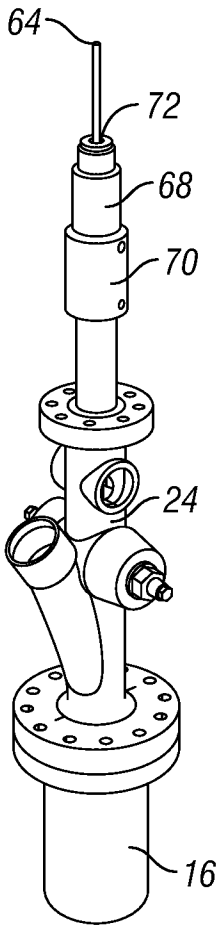
FIG. 21 shows a sealing shuttle load tube added and attached to a shuttle inside the telescoping wellhead penetrator.

FIG. 21 shows a sealing shuttle load tube 72 added and attached to the shuttle inside the telescoping wellhead penetrator 68.

Figure 23:
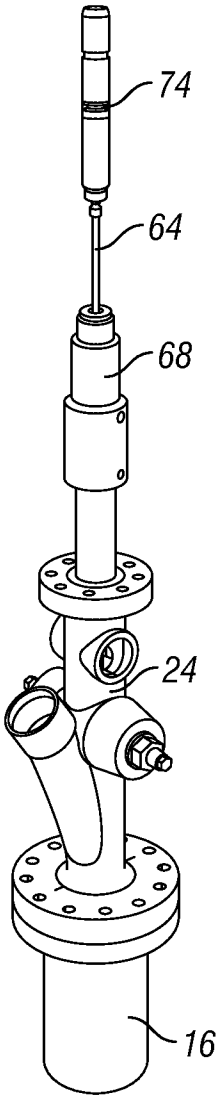
FIGS. 22 and 23 show making up a penetrator connection to the electrical cable.
Figure 22:
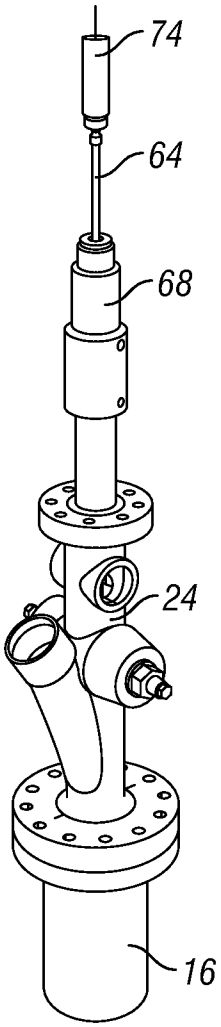

FIGS. 22 to 23 show stages in making up a penetrator connection 74 to the electrical cable 64.

Figure 24:
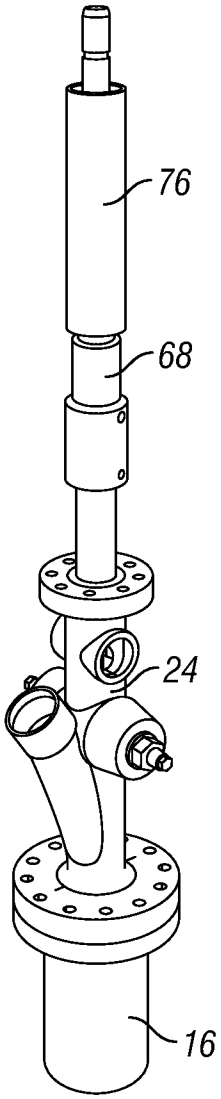
FIG. 24 shows making up a short length (pup joint) of tubing, which may have an adjustable threaded union on an upper end thereof.

FIG. 24 shows making up a short length (pup joint) of tubing 76, which may have an adjustable threaded union on an upper end thereof to account for variance in cable cut length and to accommodate cable re-termination/re-use. The pup joint 76 is provided to enable sealing engagement with the upper outlet of the rod lock BOP 24.

Figure 25:
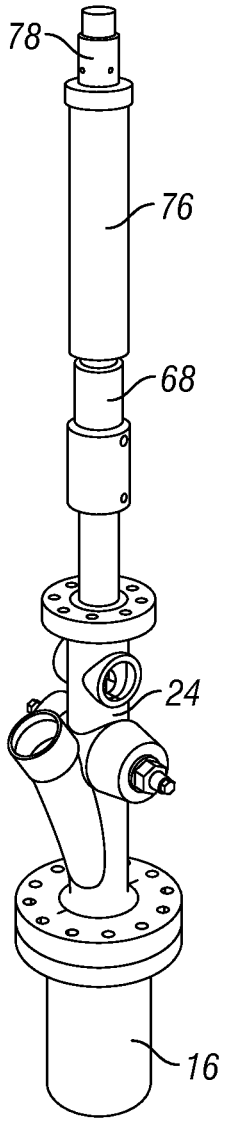
FIG. 25 shows installing a sealing wellhead adaptor to the upper end of the pup joint.
Figure 26:
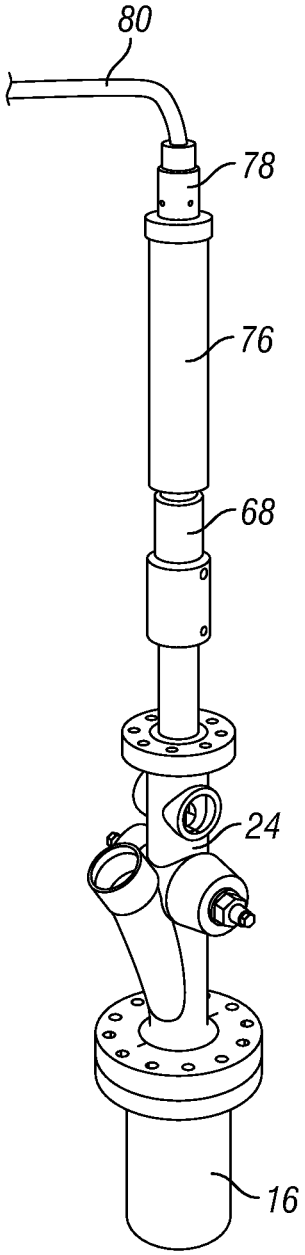
FIG. 26 shows an electrical connector "pig tail" installed to make electrical connection to the electrical conductors in the electrical cable.

FIG. 25 shows installing a load bearing seal wellhead adaptor 78 to the upper end of the pup joint 76. In FIG. 26, an electrical connector "pig tail" 80 may be installed to make electrical connection to the electrical conductors in the electrical cable 64.

In the present example embodiment, the electrical cable 64 may be a tubing encapsulated cable (TEC). TEC may be obtained, for example from Draka division of Prysmian Group (Prysmian, S.p.A.) Viale Sarca, 222 20126 Milan, Italy. Possible advantages of using TEC are resistance to damage of the electrical cable 64 by reason of fluid flowing through the coiled tubing when the ESP system 26 is operating.

Figure 27:
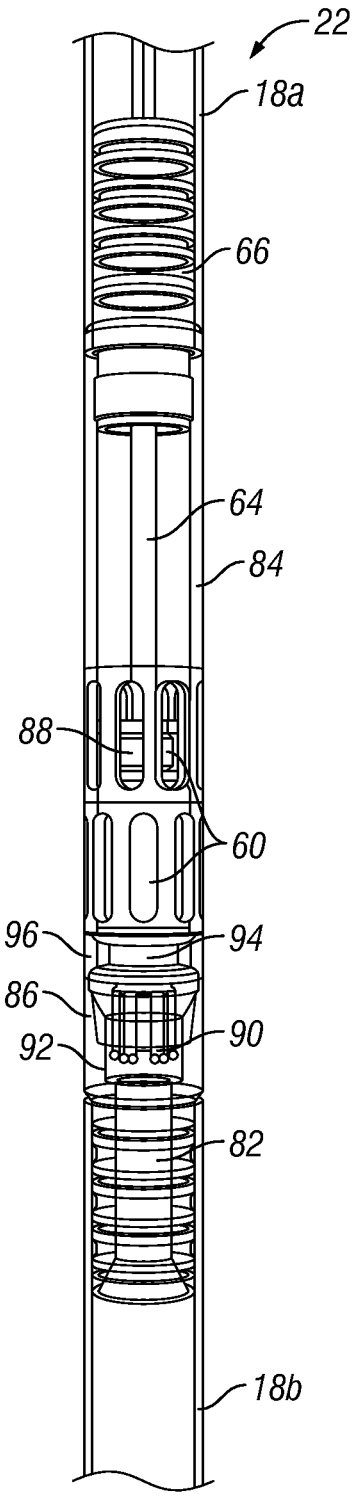
FIGS. 27 and 28 show assembled and exploded views, respectively, of the connector and cable hanger apparatus.
Figure 28:
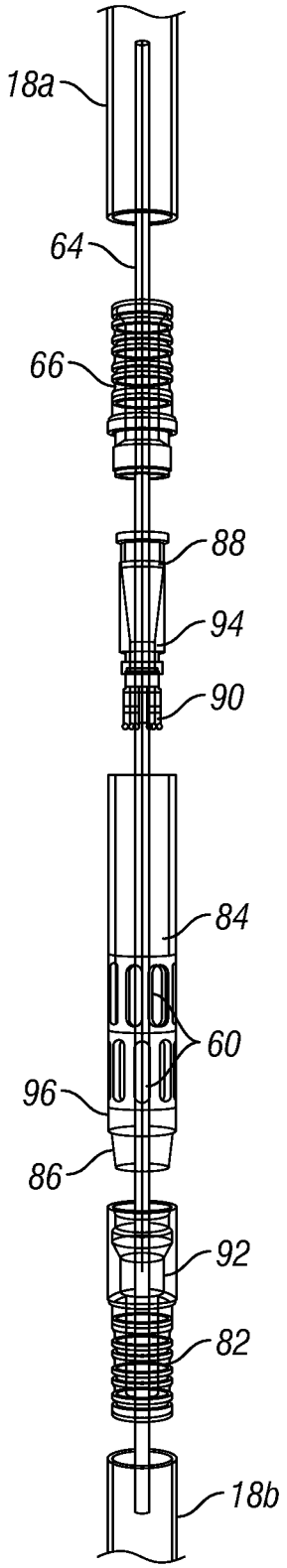

FIGS. 27 and 28 show assembled and exploded views, respectively of one example of the connector and cable hanger apparatus 22. The connector 22 may comprise a lower coiled tubing connector portion 82 which may be coupled to the lower portion 18*b* of the coiled tubing 18 deployed in the wellbore. The lower coiled tubing connector portion 82 may be sealingly and mechanically engaged to the lower coiled tubing portion 18*b* using any suitable connection, such as a roll on connection or similar internal coupling.

The connector 22 may further include an intermediate ported tubular portion 84 which includes the discharge ports 60 to enable flow of fluid from inside the coiled tubing 18 to enter the rod lock BOP 24 (FIG. 14) above the rams 25. The lower coiled tubing connector portion 82 is secured to the intermediate ported tubular portion 84 via a suitable connection. In some examples the lower coiled tubing connector portion 82 may be integrally formed with the intermediate ported tubular portion 84.

The upper coiled tubing connector portion 66 may be coupled to the upper portion 18*a* of the coiled tubing 18 using any suitable connection, such as a roll on connection or similar device; the connection need not be fluid tight. The upper coiled tubing connector portion 66 may be connected to the intermediate ported tubular portion 84 by any device that enables disconnection of the upper coiled tubing connector portion 66 at the well site while the coiled tubing 18 is suspended in the wellbore. A threaded connection may be provided, for example.

As noted above, the upper coiled tubing connector portion 66 and the upper coiled tubing portion 18*a* will have already been removed when the components of FIGS. 20 through 26 are assembled to the electrical cable 64 and the wellhead.

In the present example the connector 22 may comprise a tapered seat 86 that is configured to engage a suspension slip cone or cable hanger portion 88 mechanically affixed to the exterior of the electrical cable 64. The cable hanger portion 88 may be a two-part tapered cone assembly that frictionally engages the exterior tube of the TEC 64. As configured, the upper coiled tubing connector portion 66 may be disengaged from the intermediate ported tubular portion 84, leaving said intermediate portion 84 suspended in the wellbore by the rod lock BOP 24 and the cable 64 suspended in the intermediate ported tubular portion 84 by the cable hanger portion 88.

The cable hanger portion 88 may include on its lower end collets 90 that may engage a corresponding engagement surface 92 inside the lower coiled tubing connector portion 82. The collets 90 may hold the cable hanger portion 88 in position inside the connector 22.

A seal, such as a lip seal or O-ring 94 may be disposed about a cylindrical body of the cable hanger portion 88. When the cable hanger portion 88 is fully lowered into the connector 22, the seal 94 is seated inside a seal bore 96 to isolate the lower interior of the coiled tubing 18, such that the flow ports 60 may be closed to fluid flow. The seal bore 96 may be provided within the intermediate ported tubing portion 84, or alternatively within the lower coiled tubing connector 82

Figure 29:
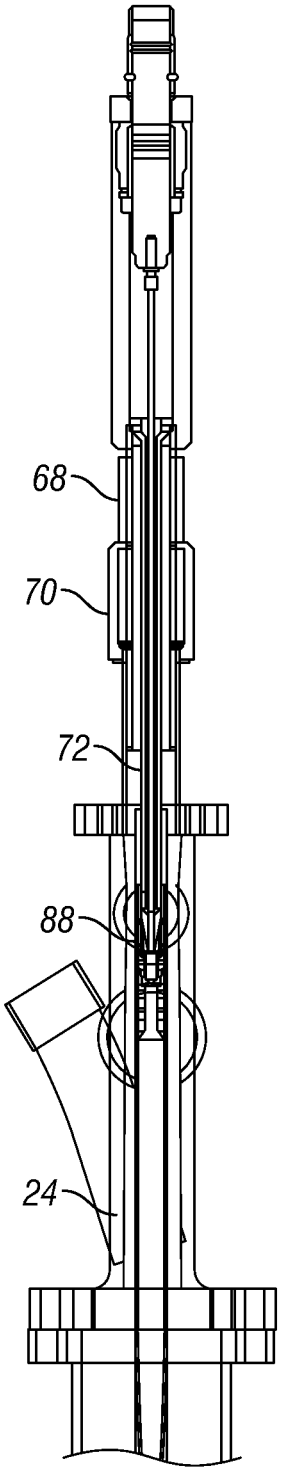
FIGS. 29 shows a cut away sectional view of the coiled tubing, the connector and cable hanger apparatus, cable slip connector and a wellhead adapter as assembled.
Figure 30:
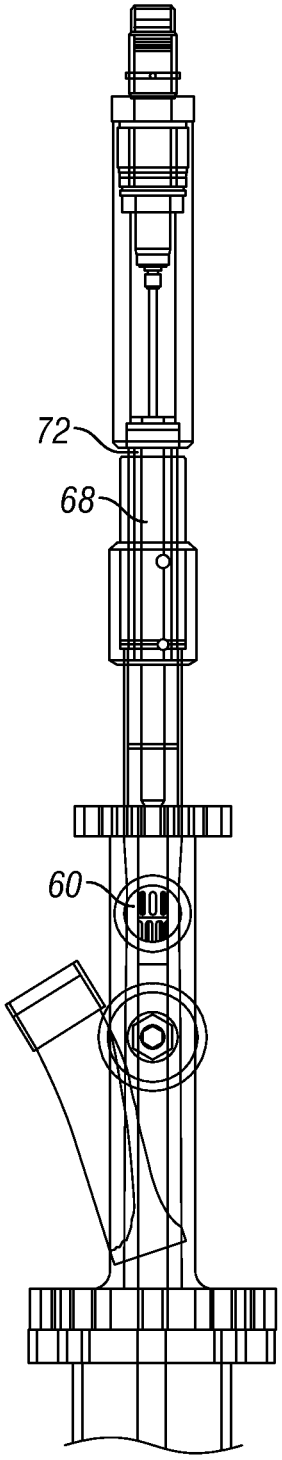
FIG. 30 shows a side view with the flow ports in the CLOSED position (hydraulic jack in lowest position).
Figure 31:
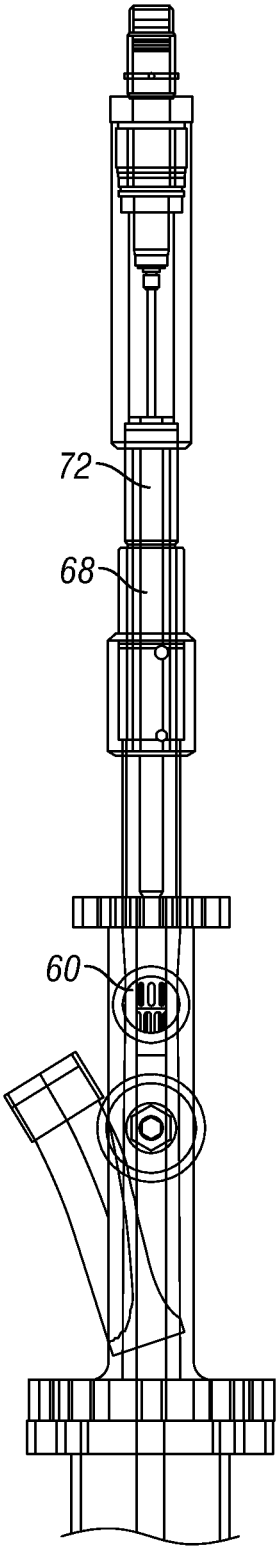
FIG. 31 shows a side view with the flow ports in the OPEN position (hydraulic jack in uppermost position), ready for production.
Figure 32:
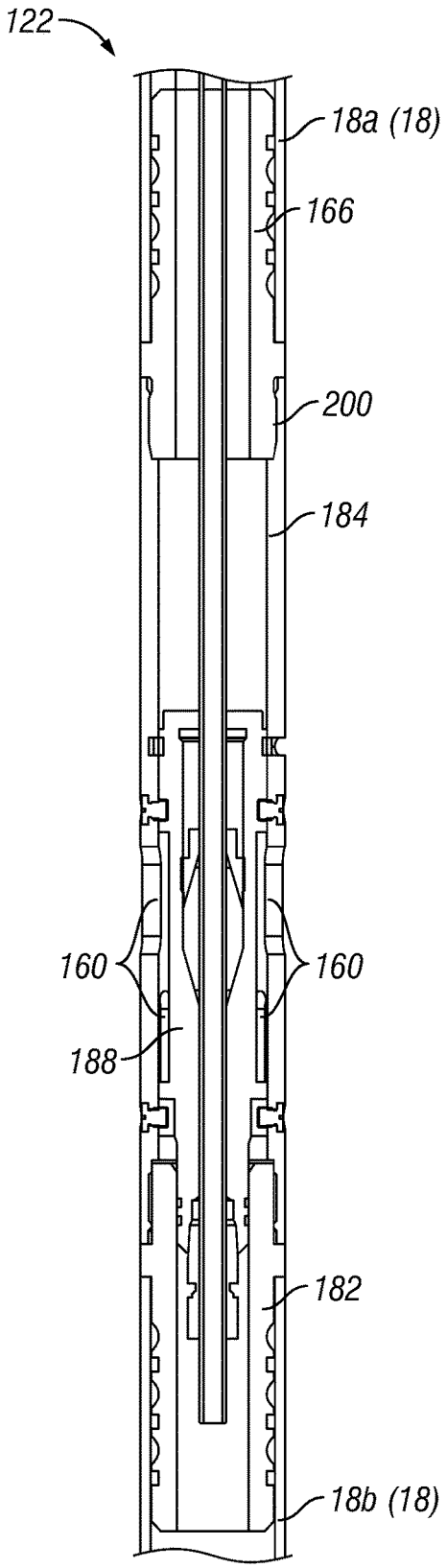
FIGS. 32 to 35 provide various views of an alternative connector and cable hanger apparatus in different configurations.

In the present example the cable hanger portion 88 functions as an internal shuttle component which is axially moveable within the intermediate ported tubular portion 84, under the control of the telescoping wellhead penetrator 68 and sealing shuttle load tube 72 (FIGS. 21 to 26), to selectively open and close the discharge ports 60 in the connector 22. Such axial movement of the cable hanger portion 88 moves the seal 94 to and from the seal bore 96 to selectively open and close the discharge ports 60. FIG. 29 provides a cross sectional view through the assembled rod lock BOP 24 and telescoping wellhead penetrator 68, with the discharge ports 60 closed. In this case the sealing shuttle load tube 72, which is moved by the hydraulic cylinder 70, extends to engage the cable hanger portion 88. FIG. 30 further illustrates the external configuration of the telescoping wellhead penetrator 68 and sealing shuttle load tube 72 when the cable hanger portion 88 is positioned to close the discharge ports 60. FIG. 32 illustrates the configuration of the telescoping wellhead penetrator 68 and sealing shuttle load tube 72 when the cable hanger portion 88 is positioned to open the discharge ports 60.

In some examples the connector and cable hanger apparatus 22 may be initially configured such that the discharge ports 60 are closed during the installation procedure. When in such an initially closed configuration the collet 90 of the cable hanger portion 88 may not yet be fully engaged within the engagement surface 92, thus permitting subsequent movement of the cable hanger portion 88. Once installation is complete the cable hanger portion 88 may be shifted upwardly by action of the telescopic wellhead penetrator 68 to open the ports 60 and allow suitable flow from the wellbore. Whenever necessary the cable hanger portion 88 may be shifted downwardly to close the discharge ports 60, for example during a retrieval operation to retrieve the coiled tubing 18 and ESP 26 form the wellbore. In some examples such re-closure of the ports 60 may involve downward movement of the cable hanger portion 88 by a sufficient distance to allow the collet 90 to fully engage within the engagement surface 92, thus providing a more permanent closure of the ports 60. Such an arrangement may require retrieval and redressing of the connector 22. In some examples, however, the collet 90 may be releasable from the engagement surface 92 upon exceeding a threshold separation or release pulling force.

It should be noted that axial movement of the cable hanger portion 88 (which functions as the internal shuttle) to open and close the discharge ports 60 is performed while mechanically connected to the cable 64. The present inventors have discovered that such an arrangement is permitted and acceptable by virtue of compliance of the cable 64. Such compliance may be provided in view of a degree of "slack" in the cable 64, for example either intentionally provided or as a function of the difference between the effective cord length of the cable 64 and that of the coiled tubing 18 when spooled on the coiled tubing reel 20 (FIG. 1). Compliance may alternatively or additionally be provided by virtue of elasticity of the cable 64. Further, in many applications the length of the cable 64 extending between the ESP 26 and the cable hanger portion 88 may be significant, such that any strain induced within the cable 64 by movement of the cable hanger portion 88 will be applied over the significant cable length, with the effective stress/strain per unit length being within acceptable limits, perhaps in some cases being almost negligible.

An alternative example connector and cable hanger apparatus 122 is illustrated in FIG. 32, reference to which is now made. The connector 122, which is illustrated in cross section in FIG. 32, is similar in many respects to the connector and cable hanger apparatus 22 described above, and as such like features share like reference numerals, incremented by 100. The connector 122 includes an upper coiled tubing connector portion 166 for connecting to an upper coiled tubing portion 18*a,* and a lower coiled tubing connector portion 182 for connecting to a lower coiled tubing portion 18*b*. The connector 12 further includes an intermediate ported tubular portion 184 which is, at least initially as illustrated, interconnected between the upper and lower coiled tubing connector portions 166, 182, wherein the intermediate ported tubular portion 184 includes a series of discharge ports 160. In some examples the lower coiled tubing connector portion 182 may be integrally formed with the intermediate ported tubular portion 184.

In the same manner as described above, the coiled tubing 18 may be deployed into a wellbore to locate an ESP (not shown in FIG. 32) at a required depth which relates to the positioning of the connector 122 proximate a surface end of the wellbore, such as within a rod lock BOP, within other well head equipment, directly within a wellhead, or the like. The connector 122 may be positioned within a support arrangement (such as within rams of a rod lock BOP, a tubing hanger of a wellhead or other wellhead equipment, or the like) such that the coiled tubing 18 may be effectively suspended below the connector 122 in the wellbore.

In a similar manner to that of the previously described connector 22, the upper coiled tubing connector portion 166 is secured to the intermediate ported tubular portion 184 via a releasable connection, which in the present example is a threaded connection 200. This releasable threaded connection 200 permits the upper coiled tubing connector portion 166 and associated upper coiled tubing portion 18*a* to be removed, in the same manner as illustrated in FIG. 18, following deployment and appropriate positioning of the connector 122.

The connector 122 further includes an internal cable hanger portion 188 which is mechanically and sealably secured to the electrical cable 64. As will be described in more detail below, the cable hanger portion 188 is axially moveable relative to the intermediate ported tubular portion 184 to open or close the discharge ports 160. As such, the cable hanger portion 188 may function as a sealing shuttle.

Figure 33:
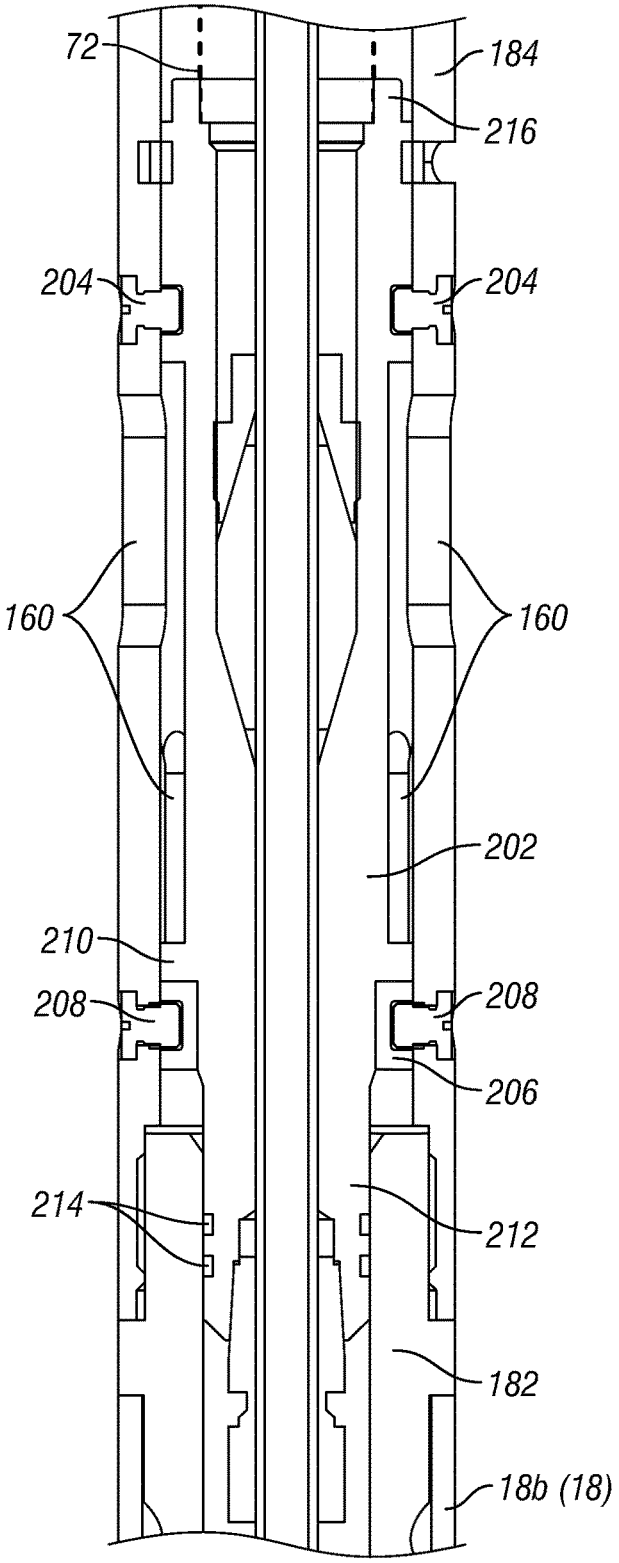

FIG. 33 is an enlarged view of the connector 122 in the region of the cable hanger portion 188, wherein the cable hanger portion 188 is illustrated in an initial deployment configuration. The cable hanger portion 188 includes a mandrel 202 which is initially secured to the intermediate ported tubular portion 184 via shear screws 204. A shoulder ring 206 is secured to the intermediate portion 184 via shear screws 208, wherein the mandrel 202 includes an annular lip 210 which is configured to engage with the shoulder ring 206. The mandrel 202 further includes a lower seal extension 212 which carries circumferential seals 214, such as O-rings. When in the illustrated deployment configuration the mandrel 202 is positioned such that the seal extension 212 extends into the lower coiled tubing connector portion 182 to provide a seal therein such that the discharge ports 160 may be considered closed and isolated from the coiled tubing 18 below the mandrel seal extension 212.

An upper end of the mandrel 202 includes a load tube connector 216 which facilitates connection with the sealing shuttle load tube 72, shown in broken outline (and first illustrated in FIG. 21). In a similar manner to that described above, the upper coiled tubing portion 18*a* and upper coiled tubing connector portion 166 will have been removed prior to insertion of the sealing shuttle load tube 72. The sealing shuttle load tube 72 may thus be used, under the control of the hydraulic cylinder 70 of the telescoping wellhead penetrator 68 (FIG. 20), to apply an axial load to the mandrel 202.

Figure 34:
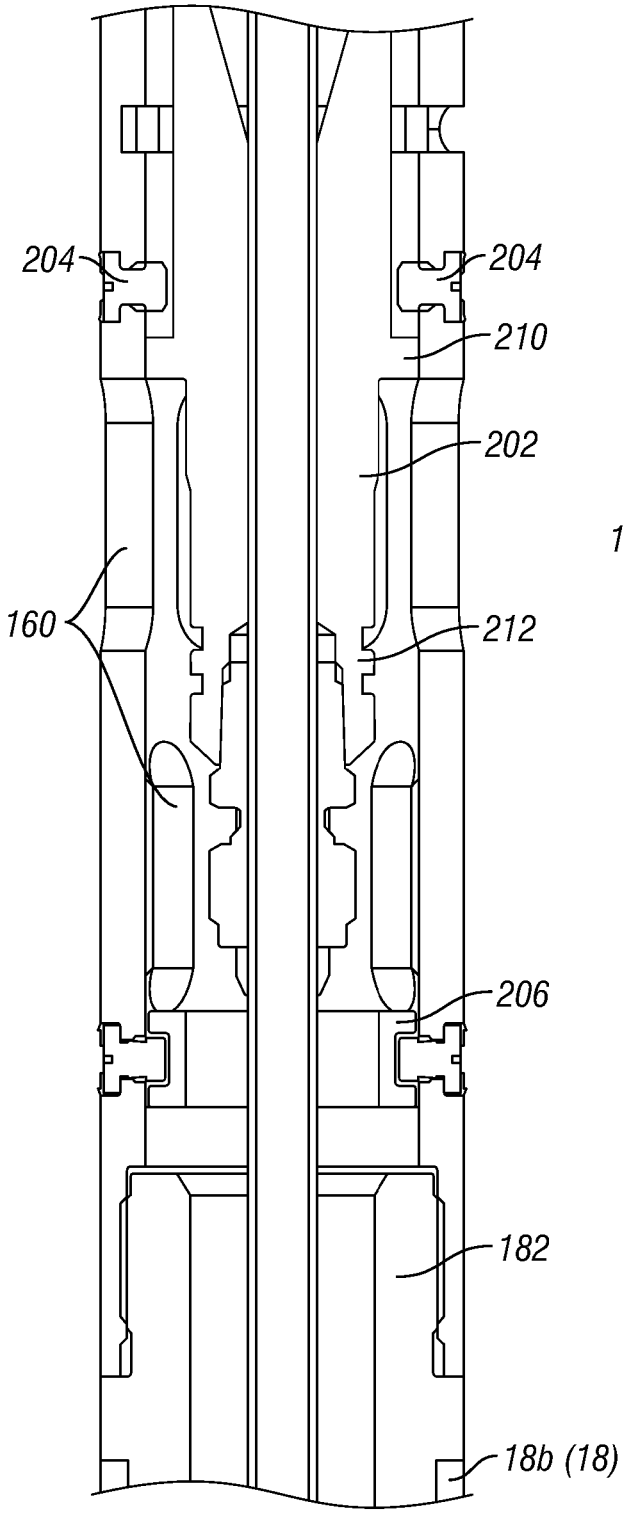
Figure 35:
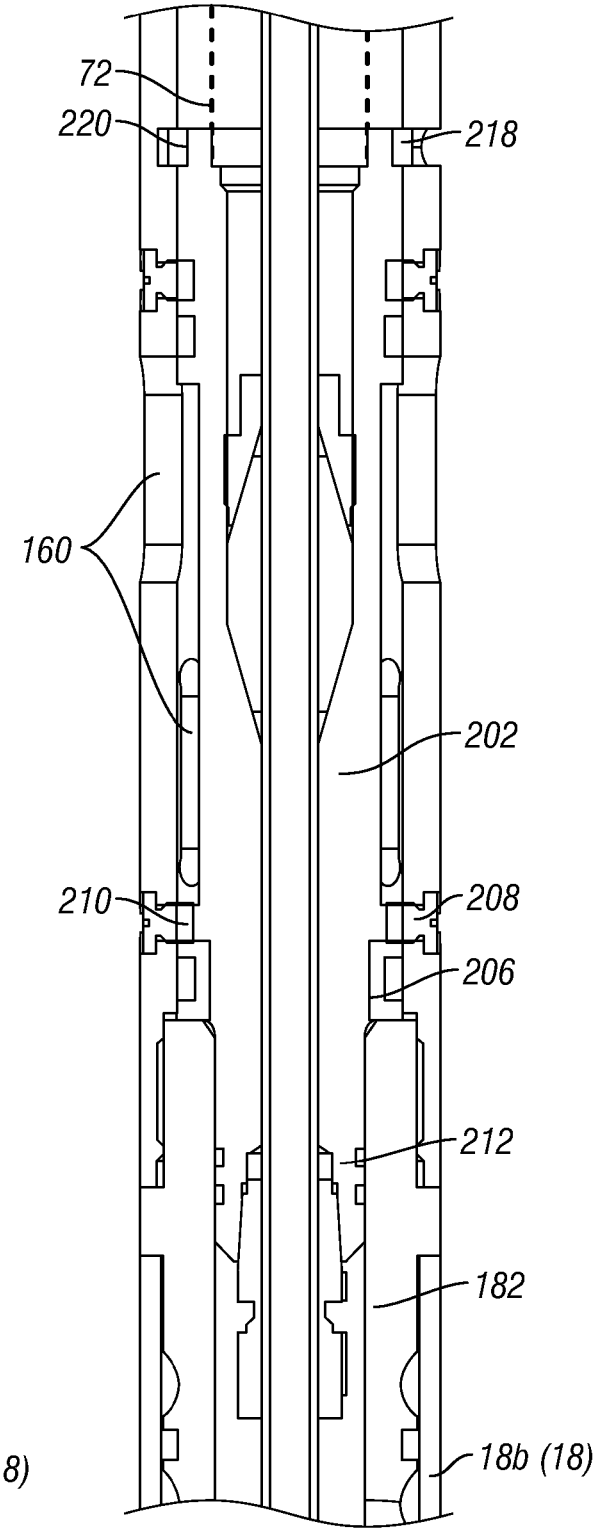

When the connector 122 is appropriately deployed, with all necessary wellhead equipment installed, the sealing shuttle load tube 72 may apply an upward force on the mandrel 202, shearing screws 204 and moving the mandrel 202 upwardly, as illustrated in FIG. 34. Such movement withdraws the sealing extension 212 from the lower coiled tubing connector portion 182, thus opening the discharge ports 160 to communicate with the lower coiled tubing portion 18*b*, permitting discharge of fluids driven by the lower ESP.

If the discharge ports 160 must be closed once again the mandrel 202 may be moved downwardly by the sealing shuttle load tube 72 to re-engage the sealing extension 212 within the lower coiled tubing connector portion 182. The mandrel 202 may be returned to the same position illustrated in FIG. 33, with the annular lip 210 of the mandrel engaged against the shoulder ring 206. In some circumstances, however, the sealing shuttle load tube 72 may apply a sufficient downward force to shear out the shoulder ring 206, thus permitting additional downward travel of the mandrel 202. This additional travel permits a latch member, such as a circlip 218, to be received within a latch recess or notch 220 formed in an upper end of the mandrel 202, thus effectively locking the mandrel 202 in position. This may be defined as a retrieval position, following which retrieval of the ESP may be initiated.

As outlined above, in some examples a connector and cable hanger apparatus (22, 122) may be located and engaged with a rod lock BOP, with rams of the rod lock BOP supporting the connector. However, in other examples the connector may be suspended in other wellhead equipment or infrastructure. In one particular example, which will now be described with reference to FIGS. 36 to 38, the connector may be configured to be suspended at the wellhead (for example in a production tree) via a tubing hanger profile.

Figure 36:
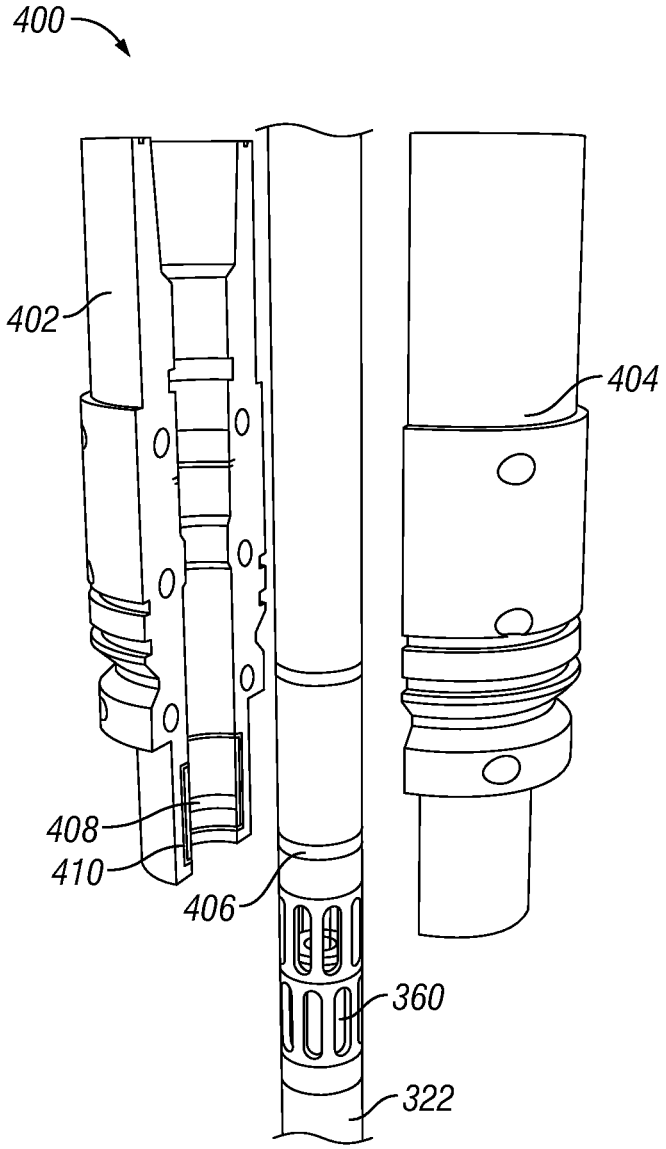
FIGS. 36 to 38 illustrate an alternative arrangement for suspending a connector and cable hanger apparatus in a wellbore.
Figure 37:
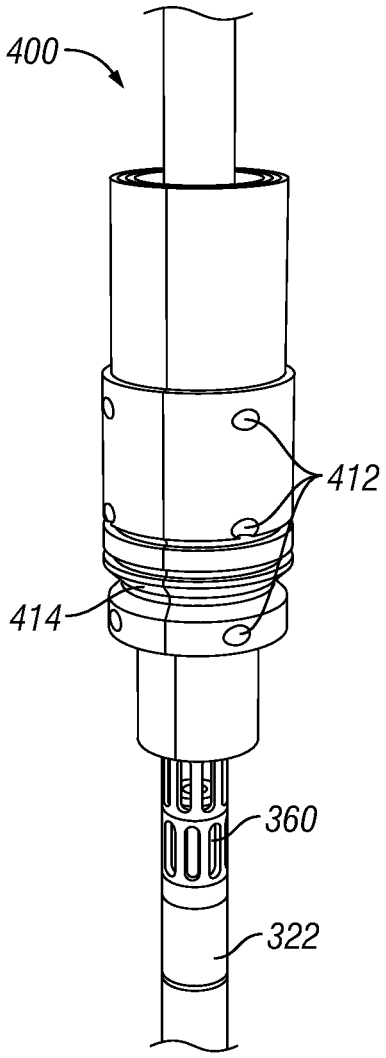
Figure 38:
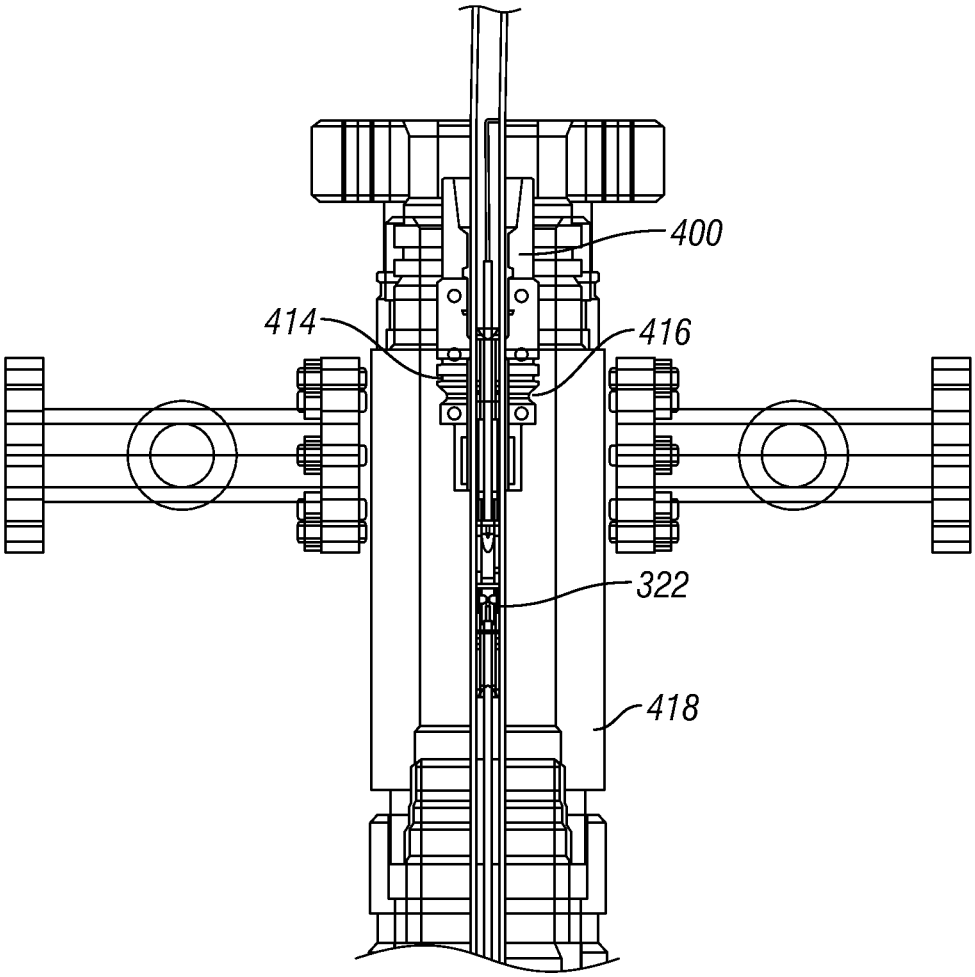

FIG. 36 illustrates a portion of a connector and cable hanger apparatus 322, which may be largely similar to either connector 22 or connector 122 described above, and as such no further detailed description will be provided, except to note the provision of discharge ports 360. A split tubing hanger 400 including two half hanger segments 402, 404 is offered to the connector 322, above the discharge ports 360. The connector 322 includes a female (or alternatively a male) grip profile 406 on an outer surface thereof, wherein each hanger segment 402, 404 includes a corresponding male (or alternatively female) grip profile 408. Each hanger segment 402, 404 also includes an internal sealing element 410. The hanger segments 402, 404 may be engaged with the outer surface of the connector 322, as illustrated in FIG. 37, such that the respective grip profiles 406, 408 are interengaged and the internal sealing elements 410 sealing engage the outer surface of the connector 322, while also providing sealing between the segments 406, 408. The hanger segments 402, 404 are secured via bolts or threaded pins 412.

When the hanger segments 402, 404 are mounted together on the connector 322 as illustrated in FIG. 37, a complete outer hanger profile 414 is defined. This hanger profile 414 is provided to match a corresponding profile in a wellhead or wellhead equipment. In the present example the split tubing hanger 400 defines a profile 414 which is configured to be received into a corresponding hanger profile 416 of a wellhead tree 418, illustrated in FIG. 38. The respective hanger profiles 414, 416 provide both mechanical support and also sealing therebetween.

Examples provided above relate to methods and corresponding apparatus to facilitate deployment of an ESP into a wellbore. The present disclosure also extends to possible retrieval methods for use in retrieving an ESP from a wellbore. In this respect an appropriate reversal of some or all deployment steps may be performed, as described below.

When retrieval is required the discharge ports in a connector and cable hanger apparatus may be closed. Subsequent to this the various equipment and infrastructure may be disassembled, such as in the reverse sequence of FIGS. 26 through to FIG. 19, with the cable 64 exposed. Following this the upper coiled tubing connector portion 66 (or a similar component) may be inserted and reconnected to the connector and cable hanger apparatus, which can be illustrated by FIG. 18. In this respect the upper coiled tubing connector 66 (or similar) may be coupled to a section of pipe, such as a section of coiled tubing, or alternatively a mandrel portion, which can be illustrated by FIG. 17. The pipe or mandrel may then be picked up, for example by the crane 12, and following release of any supporting mechanism, such as the rams 25 of the rod lock BOP 24, the coiled tubing 18 and ESP may be tripped out of the wellbore, for example using the coiled tubing reel 20 and/or the injector unit 50.

A method and connector system as described herein may enable rapid, economical deployment of an ESP system without the need to anchor the ESP system in the wellbore and without the need to deploy a workover rig or similar device to install a production tubing.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method for deploying a pump in a wellbore, comprising:

coupling the pump to an end of a coiled tubing having separate upper and lower coiled tubing sections interconnected by a releasable tubing connector;

inserting the pump into the wellbore by extending the coiled tubing therein until the releasable tubing connector is disposed in a hanger proximate a surface of the wellbore;

uncoupling the upper coiled tubing section from the releasable connector, wherein the releasable connector, lower coiled tubing section and pump are retained suspended in the wellbore from the hanger;

cutting the upper coiled tubing section and the electrical cable therein at a selected distance above the releasable tubing connector and retaining an upper coiled tubing stub portion coupled to the releasable tubing connector; and uncoupling the upper coiled tubing stub portion from the releasable tubing connector, and exposing a selected length of electrical cable.

2. The method according to claim 1, comprising operating the pump to deliver fluids towards the surface of the wellbore via the lower coiled tubing portion.

3. The method according to claim 1, comprising providing an electrical cable within the coiled tubing.

4. The method according to claim 3, wherein the electrical cable extends through the upper and lower coiled tubing sections and through the releasable tubing connector.

5. The method according to claim 3, comprising coupling the pump to the electrical cable prior to inserting the pump into the wellbore.

6. The method according to claim 3, wherein the electrical cable comprises a tubing encapsulated electrical cable.

7. The method according to claim 3, comprising securing the electrical cable within the releasable tubing connector.

8. The method according to claim 7, comprising securing the electrical cable within the releasable tubing connector prior to deployment into the wellbore.

9. The method according to claim 1, comprising mechanically engaging the releasable tubing connector with the hanger such that the lower coiled tubing portion and pump are suspended in the wellbore via the releasable tubing connector.

10. The method according to claim 1, comprising sealingly engaging the releasable tubing connector with the hanger.

11. The method according to claim 1, wherein the hanger comprises one or more rams provided in a wellhead assembly.

12. The method according to claim 1, wherein the hanger comprises a tubing hanger profile provided within a wellhead assembly.

13. The method according to claim 12, comprising providing a tubing hanger profile on the releasable tubing connector to facilitate engagement with the tubing hanger profile provided within the wellhead assembly.

14. The method according to claim 1, comprising deploying the coiled tubing from a reel.

15. The method according to claim 1, wherein the releasable tubing connector is a spoolable connector.

16. The method according to claim 1, comprising:

affixing a coiled tubing pressure control apparatus at the surface end of the well;

closing the coiled tubing pressure control apparatus to flow;

lifting the pump into a lubricator and affixing the lubricator to the top of the coiled tubing pressure control apparatus; and opening the coiled tubing pressure control apparatus prior to extending the coiled tubing.

* * * * *